US011349260B2

(12) United States Patent
Kimura

(10) Patent No.: US 11,349,260 B2
(45) Date of Patent: May 31, 2022

(54) CONNECTOR, HARNESS AND CONNECTOR ASSEMBLY

(71) Applicant: Japan Aviation Electronics Industry, Limited, Tokyo (JP)

(72) Inventor: Shinya Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/171,438

(22) Filed: Feb. 9, 2021

(65) Prior Publication Data

US 2021/0328383 A1 Oct. 21, 2021

(30) Foreign Application Priority Data

Apr. 17, 2020 (JP) ..... JP2020-073778

(51) Int. Cl.
*H01R 13/6471* (2011.01)
*H01R 12/71* (2011.01)
(Continued)

(52) U.S. Cl.
CPC ..... *H01R 13/6471* (2013.01); *H01R 12/716* (2013.01); *H01R 13/11* (2013.01); *H01R 24/60* (2013.01)

(58) Field of Classification Search
CPC ..... H01R 13/6471; H01R 13/6461; H01R 13/11; H01R 12/716; H01R 12/62;
(Continued)

(56) References Cited

U.S. PATENT DOCUMENTS 7,597,584 B2 10/2009 Yamaji
7,833,054 B2 * 11/2010 Matsumoto ..... H01R 9/053 439/585
(Continued)

FOREIGN PATENT DOCUMENTS

JP 2007-317554 A 12/2007
JP 2009-032517 A 2/2009
(Continued)

OTHER PUBLICATIONS

Extended European Search Report in 21157006.4-1201, dated Jul. 20, 2021.

*Primary Examiner* — Marcus E Harcum
(74) *Attorney, Agent, or Firm* — Collard & Roe, P.C.

(57) ABSTRACT

A connector comprises a plurality of signal terminals, a plurality of ground terminals which are configured to be connected to outer conductors of cables, and a ground member which is configured to be connected to the outer conductors. The ground member has a ground portion. The signal terminals and the ground terminals are alternately arranged in a pitch direction (Y-direction) to form one terminal row. Each of the signal terminals has a first adjustment portion. Each of the ground terminals has a second adjustment portion. The signal terminals include an outer signal terminal located at an end of the terminal row. The first adjustment portion of the outer signal terminal protrudes toward the ground portion. A position of the first adjustment portion of the outer signal terminal in a perpendicular plane (XZ-plane) is equal to or overlaps with a position of the ground portion in the perpendicular plane.

10 Claims, 12 Drawing Sheets

(51) Int. Cl.
*H01R 13/11* (2006.01)
*H01R 24/60* (2011.01)

(58) Field of Classification Search
CPC ..... H01R 12/75; H01R 12/79; H01R 12/598; H01R 24/60
USPC ..... 439/66, 67, 74, 77, 495, 581, 582
See application file for complete search history.

(56) References Cited

U.S. PATENT DOCUMENTS 7,927,122 B2 * 4/2011 Yamaji ..... H01R 9/0515 439/376
8,241,065 B2 * 8/2012 Ikari ..... H01R 12/79 439/495
8,388,370 B2 * 3/2013 Yamaji ..... H01R 13/62994 439/497
8,465,324 B2 * 6/2013 Ikari ..... H01R 13/6591 439/495
8,721,366 B2 * 5/2014 Yamaji ..... H01R 13/6582 439/607.4
9,281,597 B2 * 3/2016 Hashiguchi ..... H01R 13/24
9,431,729 B2 * 8/2016 Kondo ..... H01R 9/0512
10,355,422 B2 7/2019 Sakaizawa
10,707,603 B2 7/2020 Yufu et al.
10,741,973 B2 8/2020 Yufu et al.
10,923,858 B2 * 2/2021 Uchida ..... H01R 24/62
2003/0064614 A1 * 4/2003 Tanaka ..... H01R 13/6581 439/98
2006/0148309 A1 * 7/2006 Sakurai ..... H01R 12/592 439/495
2007/0128897 A1 * 6/2007 Kikuchi ..... H01R 12/592 439/108
2012/0252252 A1 * 10/2012 Yamaji ..... H01R 13/6581 439/310
2014/0308825 A1 * 10/2014 Hashiguchi ..... H01R 13/24 439/66
2015/0118909 A1 * 4/2015 Yokoo ..... H01R 12/88 439/607.55

FOREIGN PATENT DOCUMENTS

JP 2012-059386 A 3/2012
JP 2013-045520 A 3/2013
JP 2017-208170 A 11/2017
JP 2019-197684 A 11/2019
JP 2019-197685 A 11/2019
JP 2020107579 A * 7/2020 ..... H01R 12/79
KR 20110085862 A * 7/2011
TW I710183 B * 11/2020
WO 03/026078 A1 3/2003

* cited by examiner

FIG.9
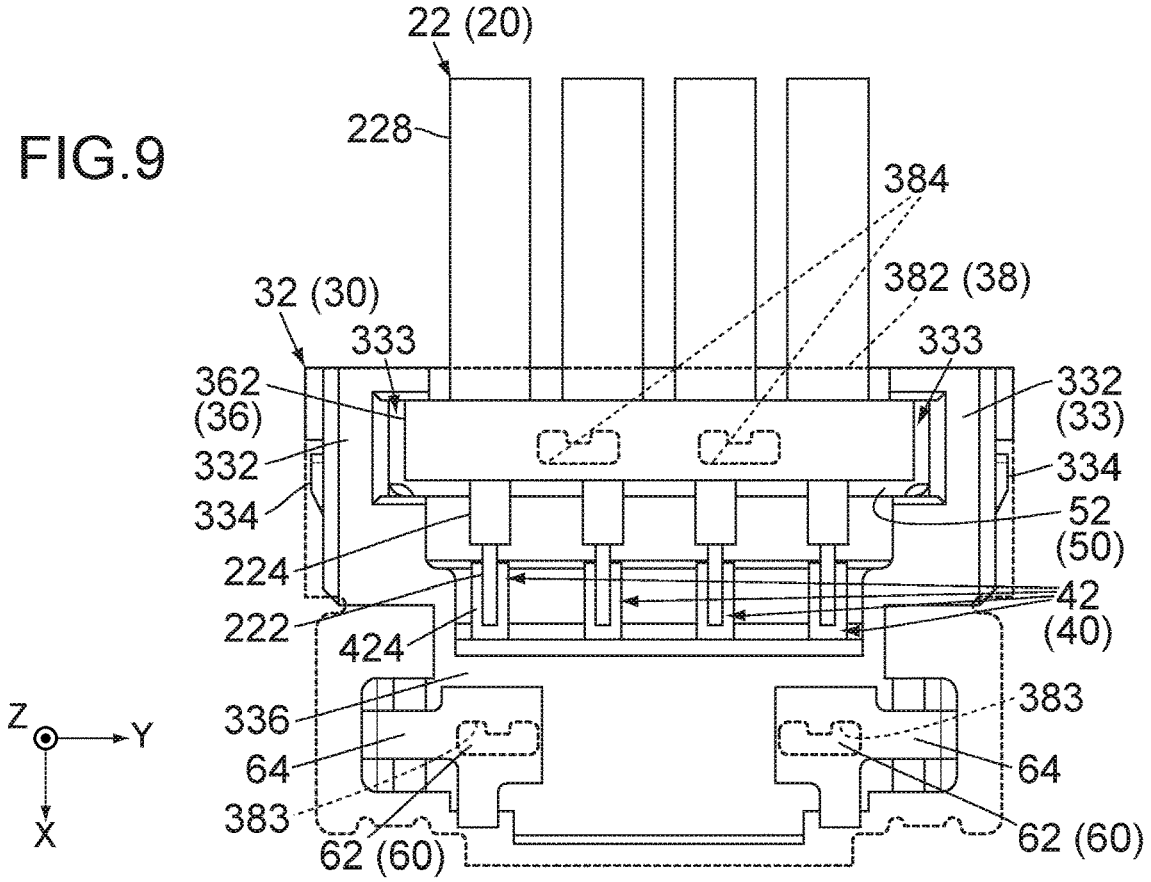
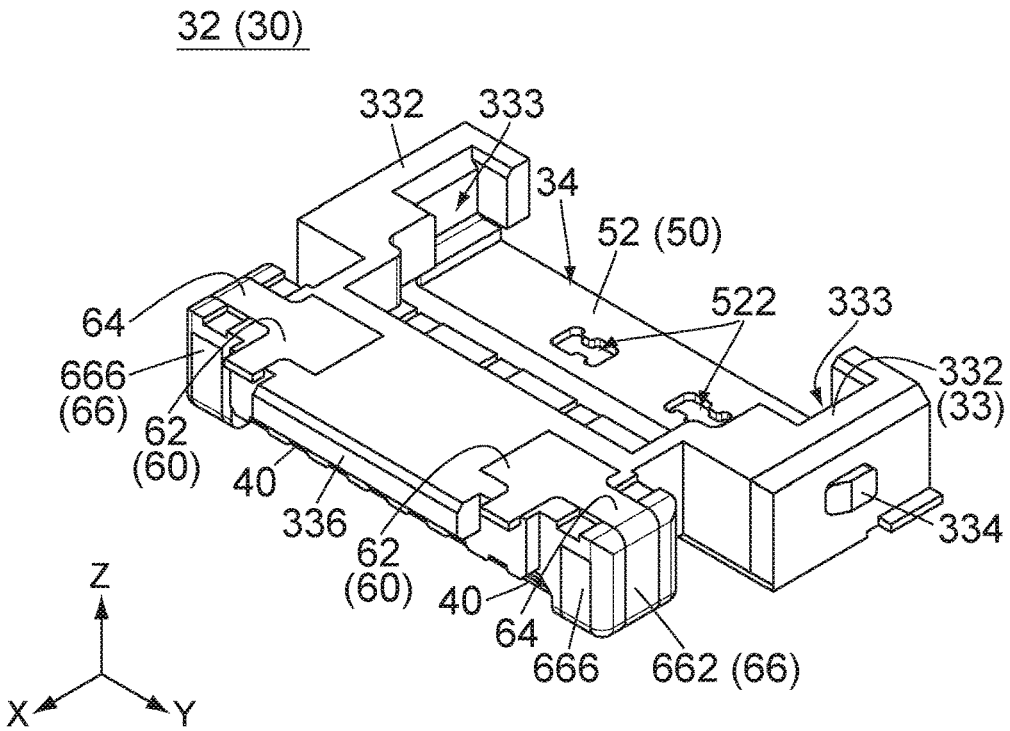
FIG.10

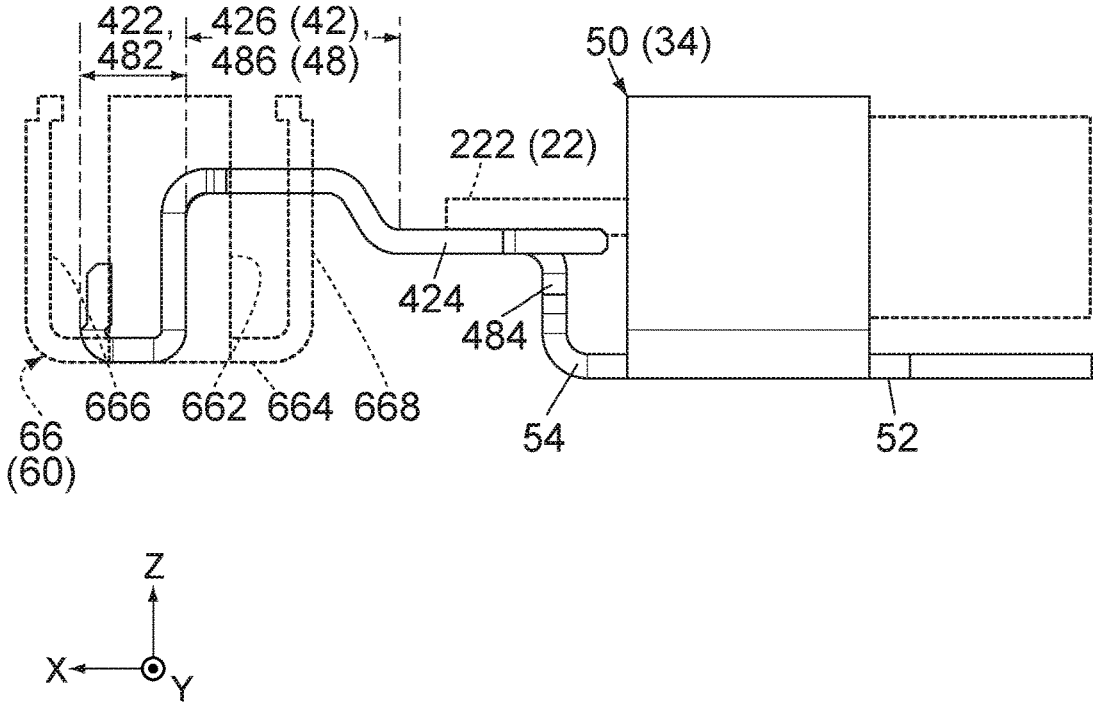
FIG.17
FIG.18
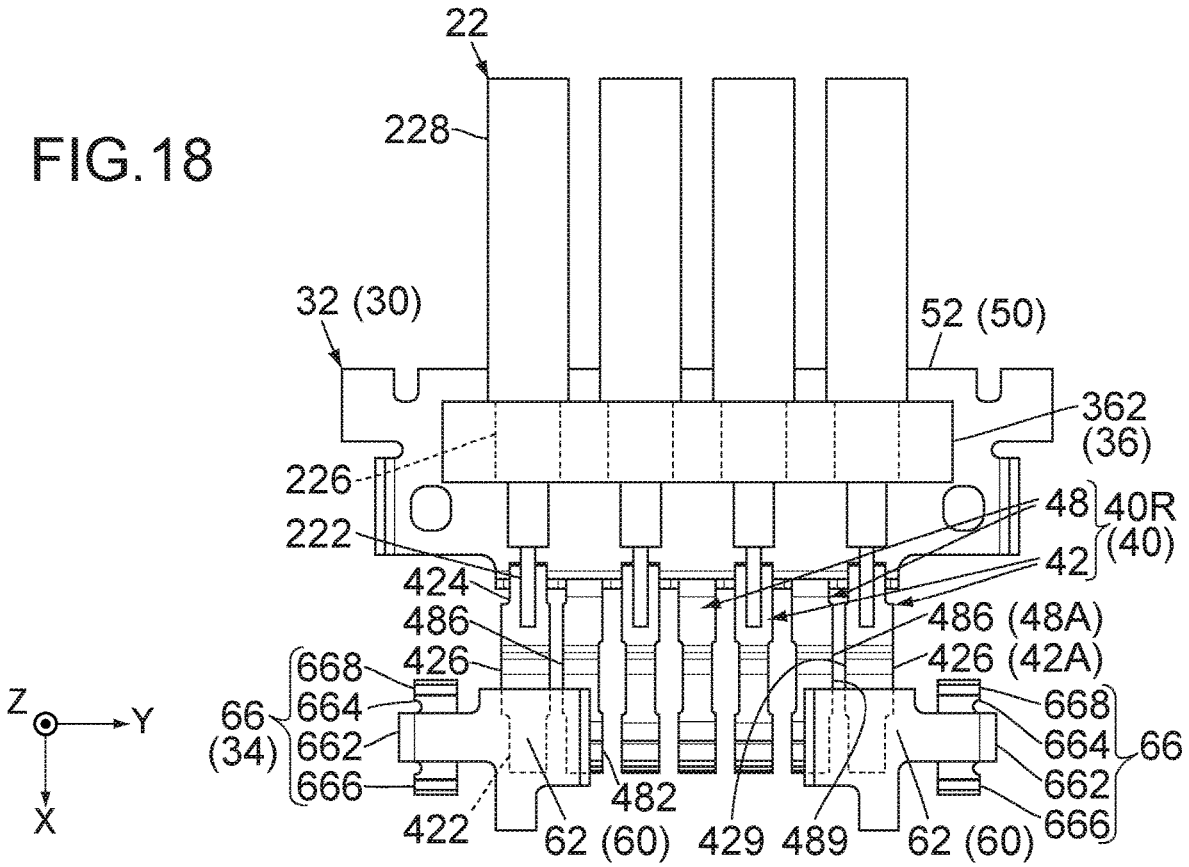

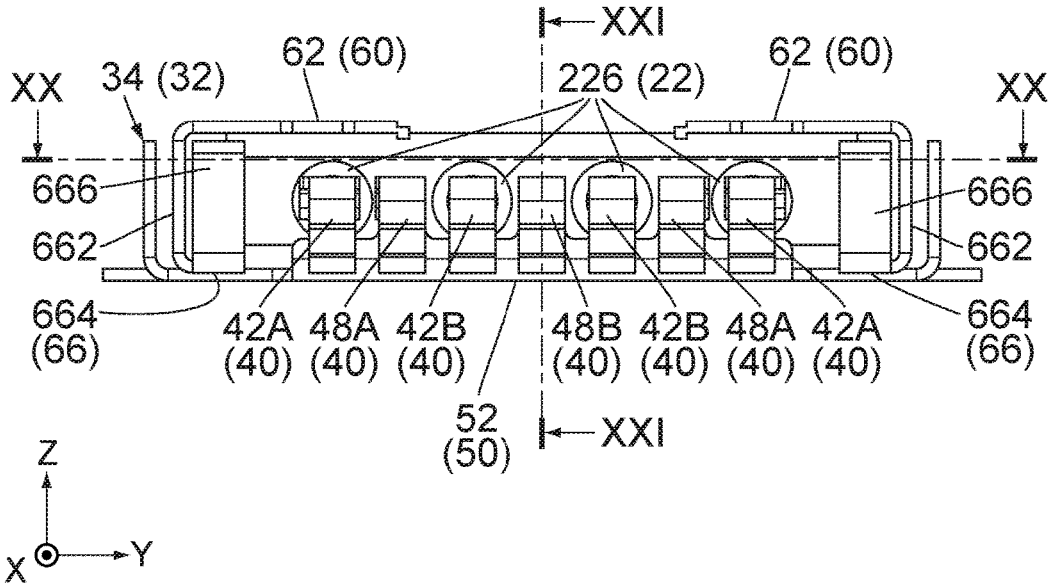
FIG.19
FIG.20
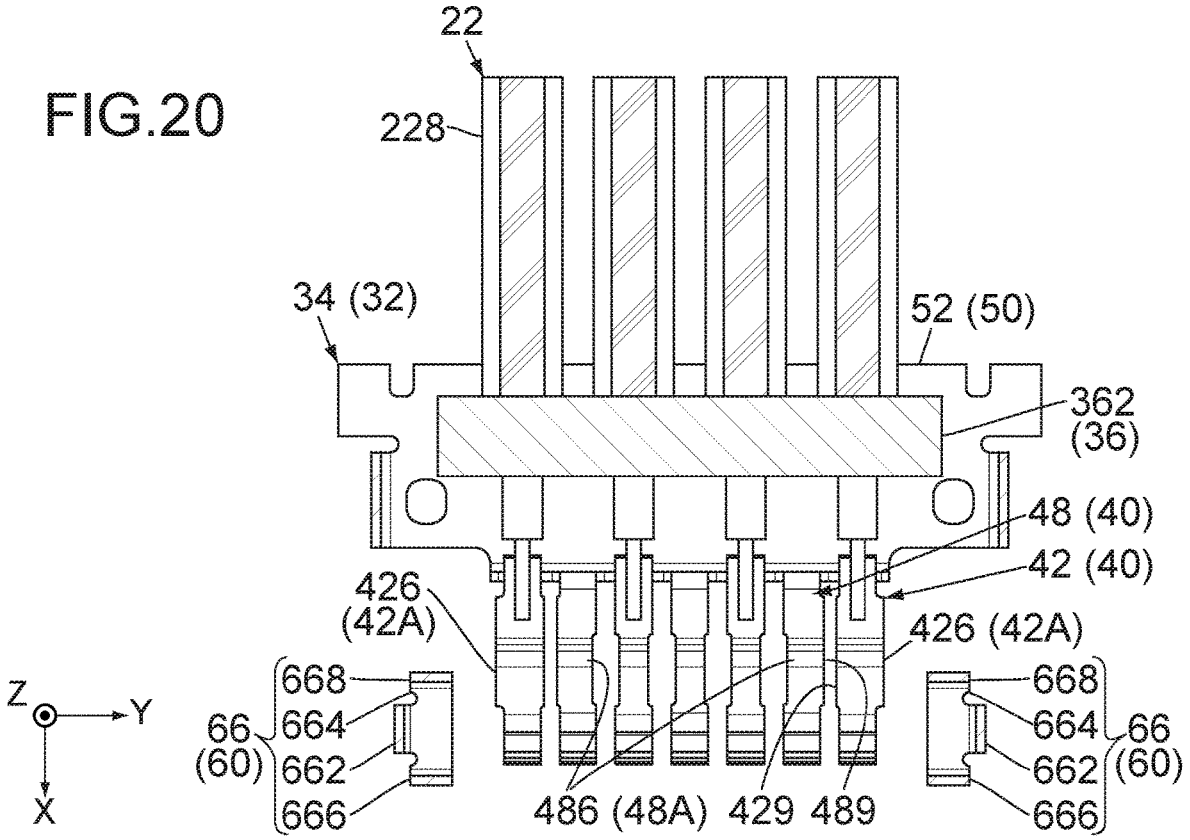

CONNECTOR, HARNESS AND CONNECTOR ASSEMBLY

CROSS REFERENCE TO RELATED APPLICATIONS

This application is based on and claims priority under 35 U.S.C. § 119 to Japanese Patent Application No. JP 2020-073778 filed Apr. 17, 2020, the content of which is incorporated herein in its entirety by reference.

BACKGROUND OF THE INVENTION

This invention relates to a cable connector mateable with an on-board connector.

For example, this type of cable connector is disclosed in JP 2009-32517A (Patent Document 1), the content of which is incorporated herein by reference.

Referring to FIGS. 22 and 23, Patent Document 1 discloses a connector 90 mateable with an on-board connector 95. The connector 90 is connected to a plurality of cables 98 to form a harness. Each of the cables 98 has a core wire 982 and an outer conductor 984. The connector 90 comprises a plurality of contacts (terminals) 92 which correspond to the core wires 982, respectively, and a shell 94 which is connected to the outer conductors 984 to have ground potential. The shell 94 has connection portions (ground portions) 942 which are configured to be connected to holddowns 952 of the on-board connector 95, respectively.

The terminals 92 of the connector 90 are arranged in a pitch direction (Y-direction). Each of the terminals 92 has a connection portion 922 configured to be connected to the corresponding core wire 982 and a contact portion (not shown) configured to be brought into contact with a mating terminal (not shown) of the on-board connector 95. The connection portion 922 and the contact portion are apart from each other in a front-rear direction (X-direction). According to this structure, the terminal 92 can be reduced in size in an upper-lower direction (Z-direction), and thereby the connector 90 can be reduced in size in the Z-direction. Thus, the connector 90 is a cable connector which can be reduced in height.

There is a request not only to reduce the height of a cable connector but also to reduce the size of the cable connector in the pitch direction.

SUMMARY OF THE INVENTION

It is therefore an object of the present invention to provide a cable connector which can be reduced in size in the pitch direction as well as size in the upper-lower direction.

In general, a cable connector is required to be improved in signal transmission characteristics. In order to meet this requirement, a cable connector is typically provided with a plurality of ground terminals for preventing degradation of transmission characteristics in addition to a plurality of signal terminals, i.e. terminals for transmitting signals of cables. Each of the signal terminals is arranged between two of the ground terminals. Thus, the signal terminals and the ground terminals are alternately arranged in a pitch direction to form a terminal row. Two of the ground terminals are arranged at opposite ends of the terminal row, respectively.

According to the typical cable connector described above, the size of the cable connector in the pitch direction can be reduced by removing the ground terminals located at the opposite ends of the terminal row. However, when the ground terminals located at the opposite ends of the terminal row are removed, two of the signal terminals, namely outer signal terminals, are arranged at the opposite ends of the terminal row, respectively. According to this arrangement, each of the outer signal terminals tends to have impedance higher than that of an inner signal terminal which is the signal terminal located between adjacent two of the ground terminals in the terminal row. As a result, transmission characteristics of the cable connector might be degraded as a whole.

The inventor of the present application has studied on the aforementioned problem and has conceived a new structure of a cable connector which can solve the aforementioned problem. According to this new structure, the outer signal terminal is arranged at an end of the terminal row in the pitch direction, and thereby the size of the cable connector in the pitch direction can be reduced. Meanwhile, a predetermined part, which has ground potential but is different from the ground terminal, is arranged outward of the outer signal terminal in the pitch direction. For example, the predetermined part is a ground portion which is configured to be connected to a holddown of an on-board connector. The outer signal terminal is formed to protrude toward the ground portion so that impedance of the outer signal terminal can be lowered. As a result, the impedance of the outer signal terminal can be balanced with the impedance of the inner signal terminal. Specifically, the cable connector according to the present invention has the features described below.

An aspect of the present invention provides a connector configured to be connected to a plurality of cables and mateable with a mating connector from above in an upper-lower direction, the mating connector being mounted on a board. Each of the cables has a core wire and an outer conductor. The mating connector comprises a plurality of mating signal terminals, a plurality of ground terminals and a holddown. The connector comprises a plurality of terminals, a holding member and a ground member which is configured to be connected to the outer conductors of the cables. The terminals include a plurality of signal terminals which correspond to the cables, respectively, and a plurality of ground terminals which are configured to be connected to the outer conductors of the cables. The signal terminals and the ground terminals are held by the holding member and are alternately arranged in a pitch direction perpendicular to the upper-lower direction to form one terminal row. The ground member is attached to the holding member and has a ground portion. The ground portion is connected to the holddown under a mated state where the connector is mated with the mating connector. Each of the signal terminals has a first contact portion, a first adjustment portion and a connection portion which is configured to be connected to the core wire of a corresponding one of the cables. The first contact portions are brought into contact with the mating signal terminals, respectively, under the mated state. The first contact portion and the connection portion of each of the signal terminals are apart from each other in a front-rear direction perpendicular to both the upper-lower direction and the pitch direction. Each of the first adjustment portions extends from the first contact portion to the connection portion in the front-rear direction. Each of the ground terminals has a second contact portion and a second adjustment portion. The second contact portions are brought into contact with the mating ground terminals, respectively, under the mated state. Each of the second adjustment portions extends from the second contact portion in the front-rear direction. A position of each of the first adjustment portions in a perpendicular plane defined by the upper-lower direction and the front-rear direction is equal to or overlaps with a position of each of the second adjustment portions in the perpendicular plane. The signal terminals include an outer signal terminal. The outer signal terminal is located at an end of the terminal row and is located between the ground portion of the ground member and one of the ground terminals in the pitch direction. The first adjustment portion of the outer signal terminal at least partially protrudes toward the ground portion in the pitch direction. A position of the first adjustment portion of the outer signal terminal in the perpendicular plane is equal to or overlaps with a position of the ground portion in the perpendicular plane. The first contact portions and the second contact portions are arranged at regular intervals in the pitch direction. The ground portion is apart from the first contact portion of the outer signal terminal by a distance longer than the regular interval in the pitch direction.

The connector according to an aspect of the present invention is a cable connector configured to be connected to a plurality of cables. According to an aspect of the present invention, the first contact portion and the connection portion of each of the signal terminals are apart from each other in the front-rear direction. This structure enables the connector to be reduced in size in the upper-lower direction. Moreover, according to an aspect of the present invention, the ground terminal is removed from the end of the terminal row arranged in the pitch direction. This structure enables the cable connector to be reduced in size in the pitch direction.

According to an aspect of the present invention, the ground portion, which is a part of the ground member, is arranged outward of the outer signal terminal in the pitch direction. The ground member is connected to the outer conductor of the cable, and thereby the ground portion has ground potential. The first adjustment portion of the outer signal terminal protrudes toward the ground portion. In addition, the position of the first adjusting portion of the outer signal terminal in the perpendicular plane is equal to or overlaps with the position of the ground portion in the perpendicular plane. This structure enables the impedance of the outer signal terminal to be close to the impedance of the signal terminal located between two of the ground terminals, so that degradation of transmission characteristics of the connector can be prevented as a whole. Thus, an aspect of the present invention provides a cable connector which can be reduced in size in the pitch direction as well as size in the upper-lower direction while degradation of transmission characteristics is prevented.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 9 is a plan view showing the connector of FIG. 8, wherein an outline of the cover shell is partially illustrated with dashed line.

FIG. 10 is a perspective view showing a base structure of the connector of FIG. 8.

FIG. 17 is a side view showing the base shell and the terminals of FIG. 14, wherein an outline of a ground portion of the ground member and an outline of the cable are illustrated with dashed line.

FIG. 18 is a plan view showing the connector of FIG. 9, wherein a holding member of the connector is not illustrated, and outlines of hidden parts of the cables and outlines of hidden parts of the terminals are illustrated with dashed line.

FIG. 19 is a front view showing the connector of FIG. 18.

FIG. 20 is a cross-sectional view showing the connector of FIG. 19, taken along line XX-XX.

Figure 1:
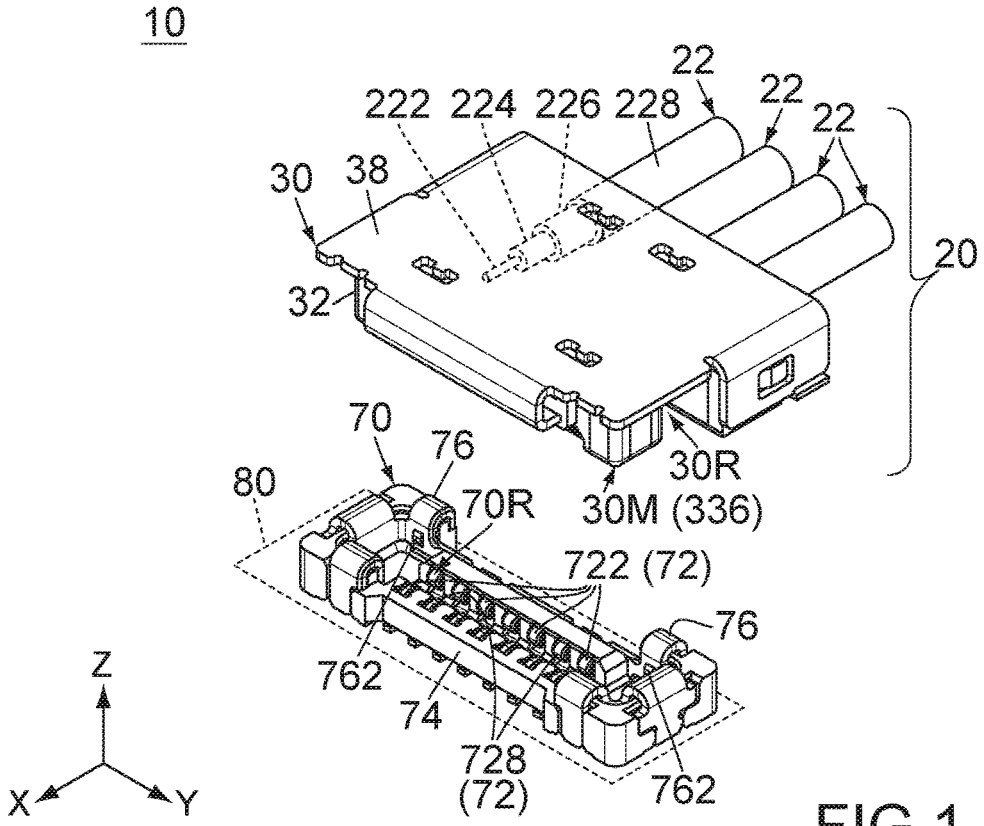
FIG. 1 is a perspective view showing a connector assembly according to an embodiment of the present invention, wherein a connector and a mating connector of the connector assembly are separated from each other, the connector is connected to a plurality of cables, and a hidden outline of one of the cables and a part of an outline of a board, on which the mating connector is mounted, are illustrated with dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
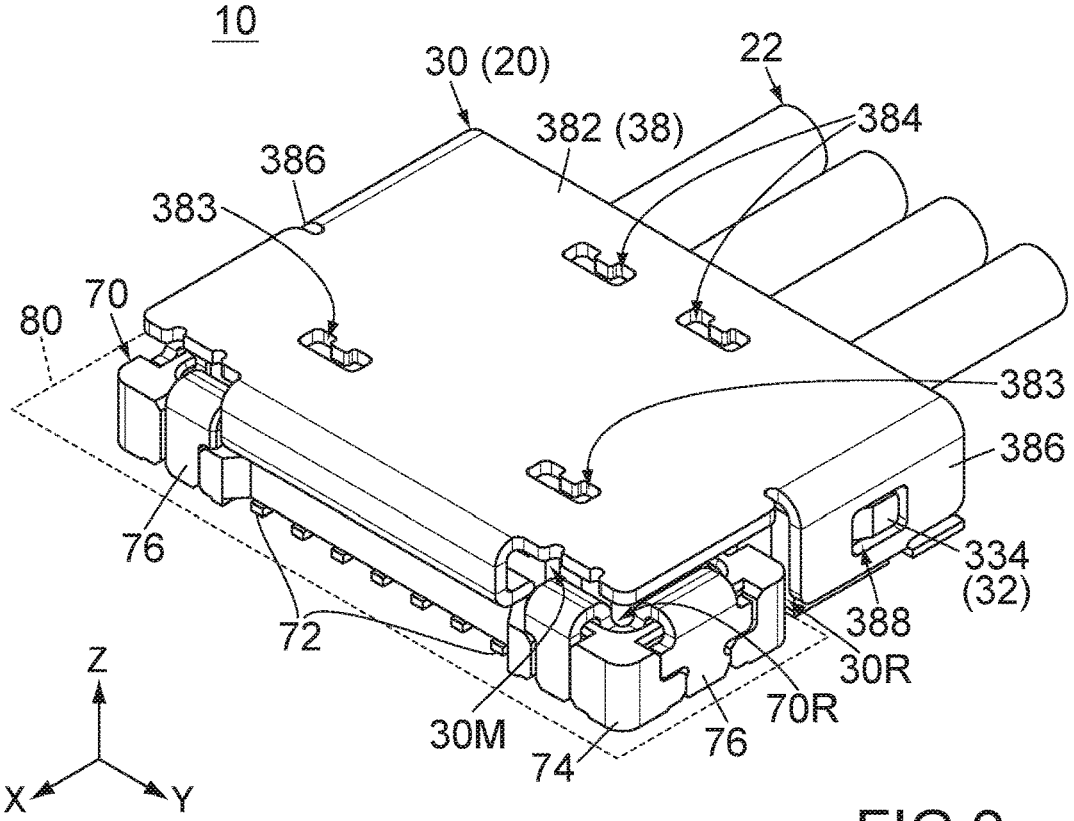
FIG. 2 is a perspective view showing the connector assembly of FIG. 1, wherein the connector and the mating connector are mated with each other.

As shown in FIGS. 1 and 2, a connector assembly 10 according to an embodiment of the present invention comprises a connector 30 and a mating connector 70. The connector 30 is a cable connector configured to be connected to a plurality of cables 22. The connector 30 forms a harness 20 together with the cables 22. Thus, the harness 20 comprises the connector 30 and a plurality of the cables 22. The mating connector 70 is an on-board connector configured to be mounted on a board 80.

Each of the cables 22 of the present embodiment is a coaxial cable. Each of the cables 22 is connected to an antenna (not shown) and transmits signals of the antenna. The board 80 of the present embodiment is installed in an electronic device (not shown) which sends and receives signals via the antennas. The connector assembly 10 of the present embodiment transmits the signals between the antennas and the electronic device. However, the usage of the cables 22 and the connector assembly 10 of the present invention is not limited specifically.

Referring to FIG. 1, each of the cables 22 of the present embodiment has a core wire 222 made of conductor, an inner insulator 224 made of insulator, an outer conductor 226 made of conductor and an outer insulator 228 made of insulator. Each of the core wires 222 transmits signals. Each of the inner insulators 224 covers and insulates the core wire 222. Each of the core wires 222 is partially exposed from the inner insulator 224 and is connected to the connector 30. Each of the outer conductors 226 covers the inner insulator 224 and electro-magnetically shields the core wire 222. Each of the outer insulators 228 covers and insulates the outer conductor 226. Each of the outer conductors 226 is partially exposed from the outer insulator 228 and is connected to the connector 30.

Each of the cables 22 of the present embodiment has the aforementioned structure. However, the structure of each of the cables 22 is not limited to the present embodiment, provided that each of the cables 22 has the core wire 222 for transmitting signals and the outer conductor 226 having ground potential.

Hereafter, explanation will be made about a structure for mating the connector 30 with the mating connector 70 according to the present embodiment.

Referring to FIGS. 1 and 2, the connector 30 of the present embodiment comprises a fit portion 30M and a receiving portion 30R. The fit portion 30M is located in the vicinity of a front end (positive X-side end) of the connector 30 in a front-rear direction (X-direction) perpendicular to the Z-direction and extends along a pitch direction (Y-direction) perpendicular to both the X-direction and the Z-direction. The receiving portion 30R is located rearward of the fit portion 30M and faces the negative X-side of the fit portion 30M. The receiving portion 30R extends along the Y-direction and opens outward at opposite sides in the Y-direction. The receiving portion 30R is a space which is recessed upward, i.e. in the positive Z-direction, so that the fit portion 30M projects downward, i.e. in the negative Z-direction.

The mating connector 70 of the present embodiment comprises a mating receiving portion 70R which is mateable with the fit portion 30M. The mating receiving portion 70R is a space which is recessed downward and opens upward. The mating receiving portion 70R is located at the middle of the mating connector 70 in a horizontal plane (XY-plane) perpendicular to the Z-direction. The mating receiving portion 70R extends along the Y-direction.

The connector 30 is mateable with the mating connector 70, which is mounted on the board 80, from above in an upper-lower direction (Z-direction). In detail, the fit portion 30M can be inserted into the mating receiving portion 70R along the Z-direction. When the fit portion 30M is inserted in the mating receiving portion 70R, a rear part (negative X-side part) of the mating connector 70 is received in the receiving portion 30R. At that time, the connector 30 is under a mated state where the connector 30 is mated with the mating connector 70. Each of the cables 22 is electrically connected with the board 80 under the mated state. The connector 30 mated with the mating connector 70 can be removed from the mating connector 70 by removing the fit portion 30M upward from the mating receiving portion 70R.

Figure 3:
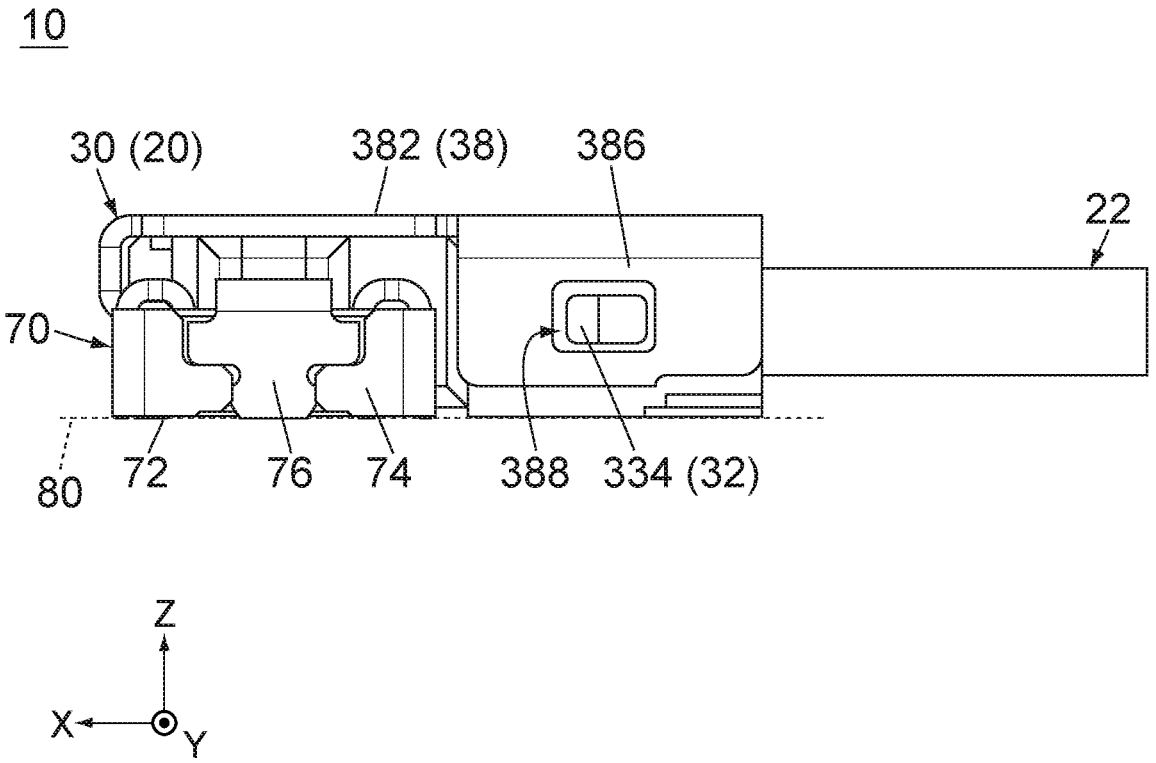
FIG. 3 is a side view showing the connector assembly of FIG. 2.

Referring to FIG. 3, because of the aforementioned structure for mating the connector 30 with the mating connector 70 according to the present embodiment, the size of the connector assembly 10 in the Z-direction under the mated state is substantially equal to the size of the connector 30 in the Z-direction. Referring to FIG. 2, the size of the connector assembly 10 in the Y-direction under the mated state is substantially equal to the size of the connector 30 in the Y-direction. However, the structure for mating the connector 30 with the mating connector 70 is not specifically limited, provided that the connector 30 and the mating connector 70 are mateable with each other along the Z-direction.

Hereafter, explanation will be made about a structure of the mating connector 70 of the present embodiment.

Referring to FIGS. 1 to 3, the mating connector 70 of the present embodiment comprises a plurality of mating terminals 72 each made of conductor such as metal, a mating holding member 74 made of insulator and two holddowns 76 each made of conductor such as metal. Referring to FIG. 1, the mating receiving portion 70R is formed in the mating holding member 74.

Figure 4:
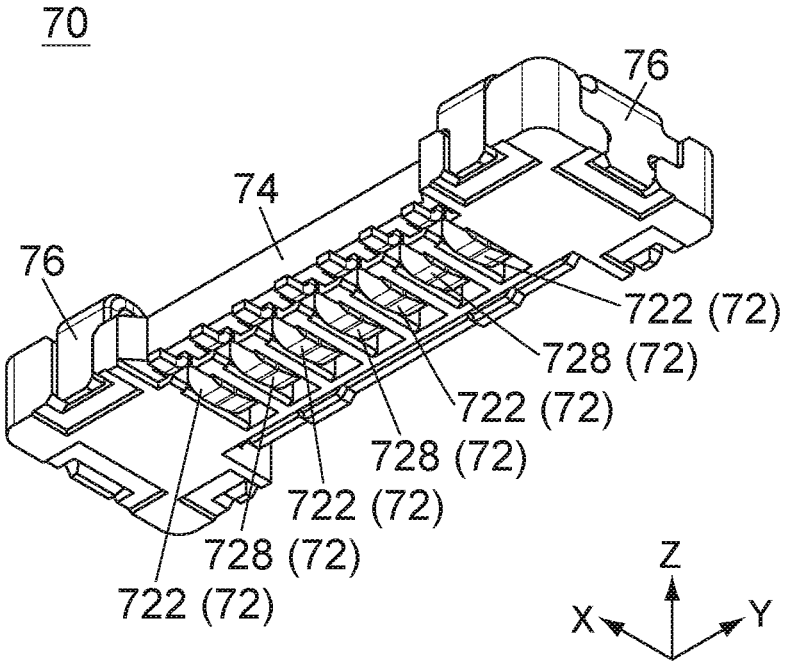
FIG. 4 is a perspective view showing the mating connector of FIG. 1.

Referring to FIGS. 1 and 4, the mating terminals 72 are held by the mating holding member 74 and are arranged in a single row along the mating receiving portion 70R. The mating terminals 72 have shapes same as each other. Each of the mating terminals 72 is partially exposed in the mating receiving portion 70R and is partially exposed downward. Referring to FIG. 3, when the mating connector 70 is mounted on the board 80, a lower end (negative Z-side end) of each of the mating terminals 72 is fixed on and connected to a conductive pad (not shown) of the board 80 via soldering, etc.

Figure 5:
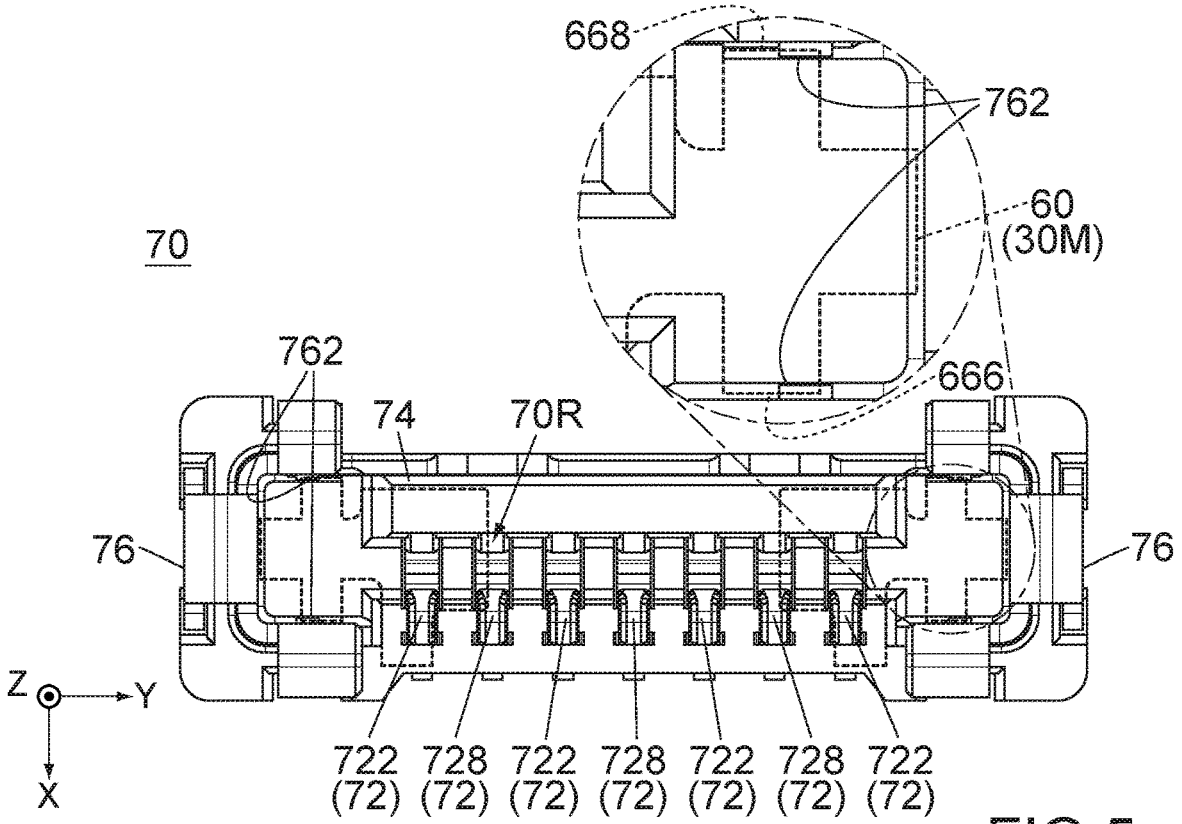
FIG. 5 is a plan view showing the mating connector of FIG. 4, wherein outlines of ground members of the connector under a mated state is illustrated with dashed line, and a part of the mating connector enclosed by chain dotted lines is enlarged and illustrated.

Referring to FIGS. 4 and 5, the mating terminals 72 consist of a plurality of mating signal terminals 722 and a plurality of mating ground terminals 728. Thus, the mating connector 70 comprises a plurality of the mating signal terminals 722 and a plurality of the mating ground terminals 728. The mating signal terminals 722 and the mating ground terminals 728 are arranged alternately in the Y-direction. Referring to FIG. 1, the mating signal terminals 722 are provided so as to correspond to the cables 22, respectively. Each of the mating signal terminals 722 transmits signals between the core wire 222 of the corresponding cable 22 and the board 80 under the mated state (see FIG. 2). Each of the mating ground terminals 728 grounds the outer conductors 226 of the cables 22 to the board 80 under the mated state.

Referring to FIGS. 1, 2, 4 and 5, the two holddowns 76 are arranged at opposite sides of the mating receiving portion 70R in the Y-direction, respectively, and are held by the mating holding member 74. The two holddowns 76 have shapes which are mirror images to each other with respect to a perpendicular plane defined by the X-direction and the Z-direction. Each of the holddowns 76 is partially exposed in the mating receiving portion 70R and partially extends downward to be exposed downward. Referring to FIG. 3, when the mating connector 70 is mounted on the board 80, a lower end of each of the holddowns 76 is fixed on and connected to a conductive pad (not shown) of the board 80 via soldering, etc. Each of the holddowns 76 grounds the outer conductors 226 (see FIG. 1) of the cables 22 to the board 80 under the mated state.

Referring to FIGS. 1 and 5, each of the holddowns 76 is provided with two lock projections 762. The two lock projections 762 are located in the mating receiving portion 70R and project toward each other in the X-direction. Referring to FIG. 5, when the fit portion 30M is received in the mating receiving portion 70R, the two lock projections 762 of each of the holddowns 76 sandwich and hold the fit portion 30M in the X-direction to lock the mated state.

The mating connector 70 of the present embodiment has the aforementioned structure. However, the present invention is not limited thereto. The structure of the mating connector 70 can be variously modified, provided that the structure of the mating connector 70 corresponds to the structure of the connector 30 (see FIG. 1). For example, the mating signal terminal 722 and the mating ground terminal 728 may have shapes different from each other. The two holddowns 76 may have shapes which are not mirror images to each other. The lock projections 762 may be provided as necessary. The mating connector 70 may further comprise another member in addition to the aforementioned members.

Hereafter, explanation will be made about a structure of the connector 30 of the present embodiment.

Figure 6:
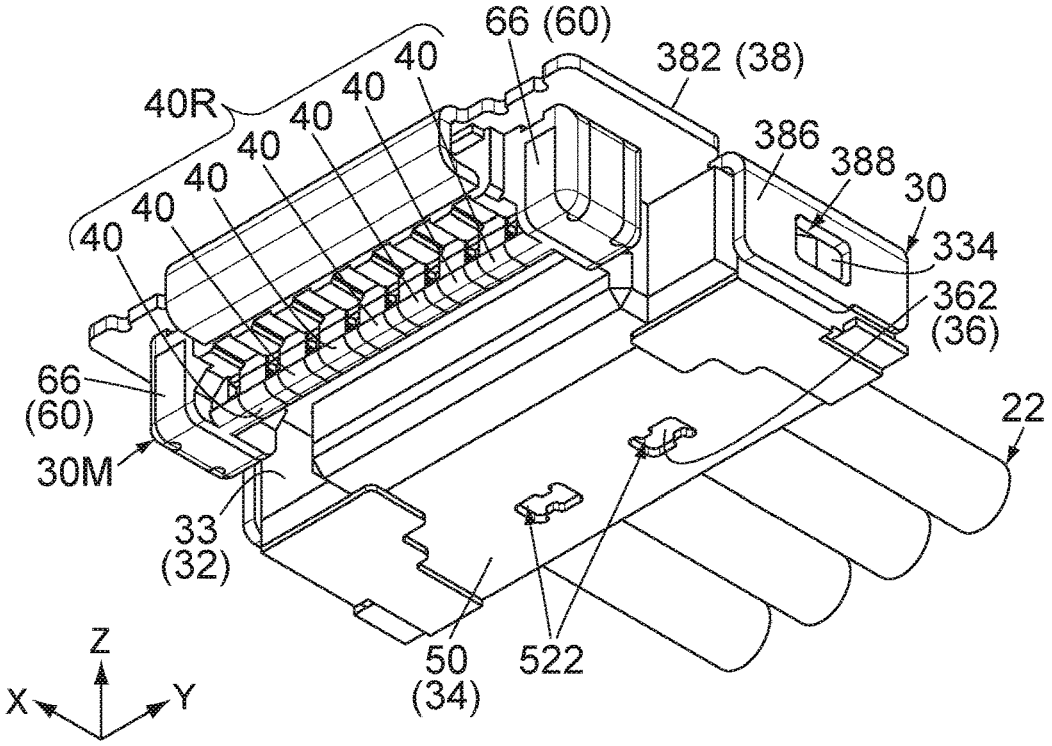
FIG. 6 is a perspective view showing the connector of FIG. 1.
Figure 8:
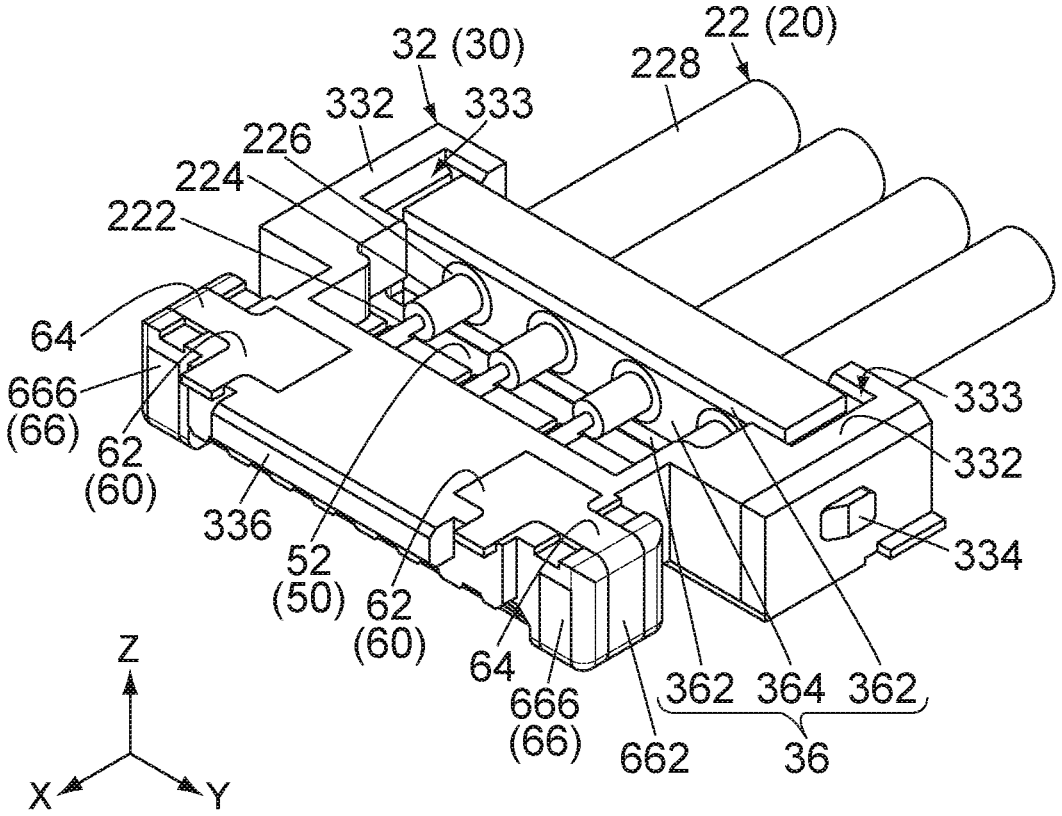
FIG. 8 is a perspective view showing the connector of FIG. 1, wherein a cover shell of the connector is detached.

Referring to FIGS. 6 and 8, the connector 30 of the present embodiment comprises a base structure 32, a cable-holding structure 36 and a cover shell 38 made of conductor. The connector 30 of the present embodiment is formed of only the aforementioned structures and member. However, the present invention is not limited thereto. For example, the connector 30 may further comprise another structure or member in addition to the aforementioned structures and member.

Referring to FIG. 10, the base structure 32 of the present embodiment comprises a holding member 33 made of insulator and a conductor structure 34. The holding member 33 is a unitary molded member. The conductor structure 34 is an assembly formed of a plurality of members each made of conductor. The conductor structure 34 is insert-molded in the holding member 33 to be held by the holding member 33. Thus, the connector 30 of the present embodiment comprises the single holding member 33 in which the conductor structure 34 is embedded. However, the present invention is not limited thereto. For example, the holding member 33 may be formed of a plurality of members combined to each other. The conductor structure 34 may be partially press-fit in the holding member 33 to be held by the holding member 33.

Figure 11:
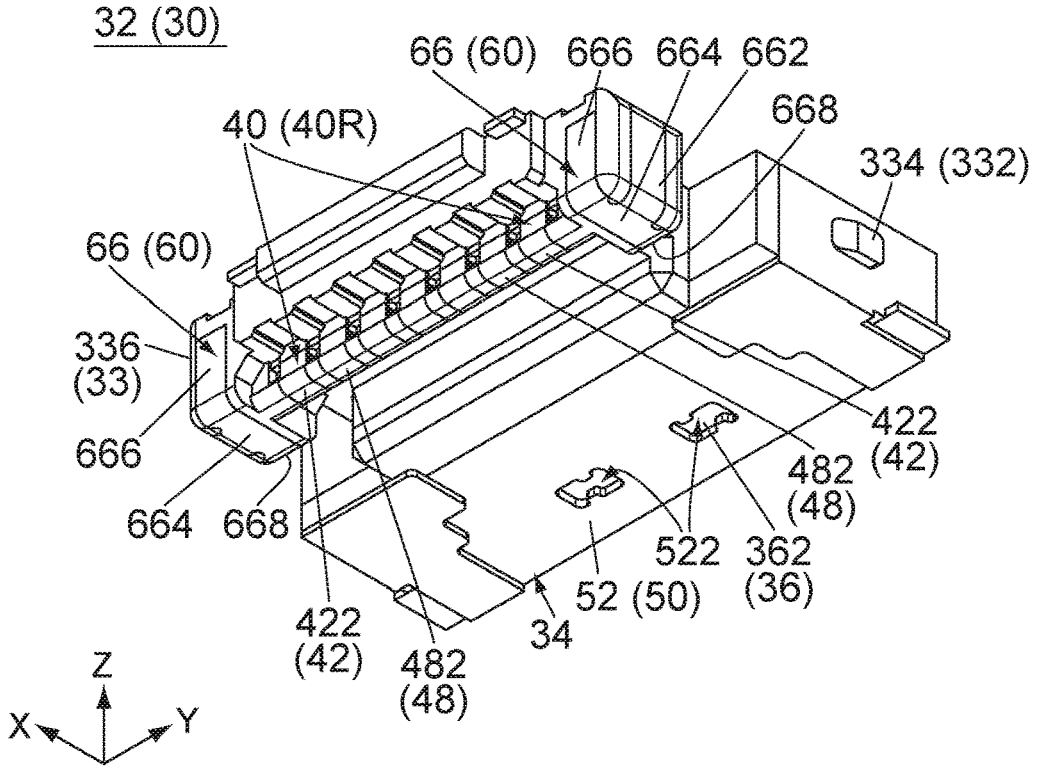
FIG. 11 is another perspective view showing the base structure of FIG. 10.

Referring to FIGS. 10 and 11, the holding member 33 of the present embodiment has two accommodation walls 332 and a holding portion 336. As shown in FIG. 10, the accommodation walls 332 are rear parts of the holding member 33 and are located at opposite sides of the holding member 33 in the Y-direction, respectively. Each of the accommodation walls 332 is formed with a recessed portion 333 and an engagement projection 334. Each of the recessed portions 333 is a recess which is located on an inner side of the accommodation wall 332 and is recessed outward of the holding member 33 in the Y-direction. The two recessed portions 333 face each other in the Y-direction. Each of the engagement projections 334 is provided on an outer wall surface of the accommodation wall 332 in the Y-direction and projects outward in the Y-direction. The holding portion 336 is a front part (positive X-side part) of the holding member 33 and extends along the Y-direction over the holding member 33. The holding portion 336 works as the fit portion 30M (see FIG. 1) of the connector 30.

The holding member 33 of the present embodiment has the aforementioned structure. However, the structure of the holding member 33 is not specifically limited, provided that the conductor structure 34 can be held by the holding member 33.

Referring to FIGS. 10 and 11, the conductor structure 34 of the present embodiment includes a plurality of terminals 40 each made of conductor, a base shell 50 made of conductor and two ground members 60 each made of conductor. Thus, the connector 30 of the present embodiment comprises a plurality of the terminals 40, the base shell 50 and the two ground members 60. The conductor structure 34 of the present embodiment is formed of only the terminals 40, the base shell 50 and the ground members 60. However, the present invention is not limited thereto. For example, the base shell 50 may be provided as necessary. Instead, the conductor structure 34 may further comprise another member in addition to the aforementioned members.

Figure 14:
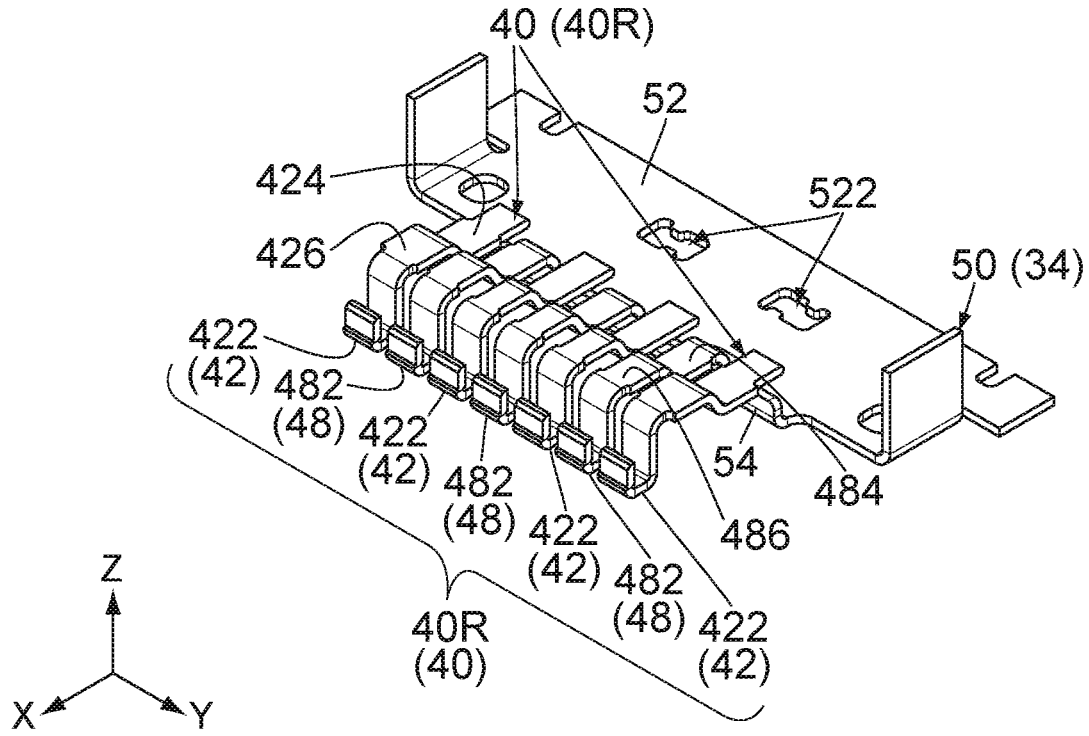
FIG. 14 is a perspective view showing a base shell and terminals of the conductor structure of FIG. 12.
Figure 15:
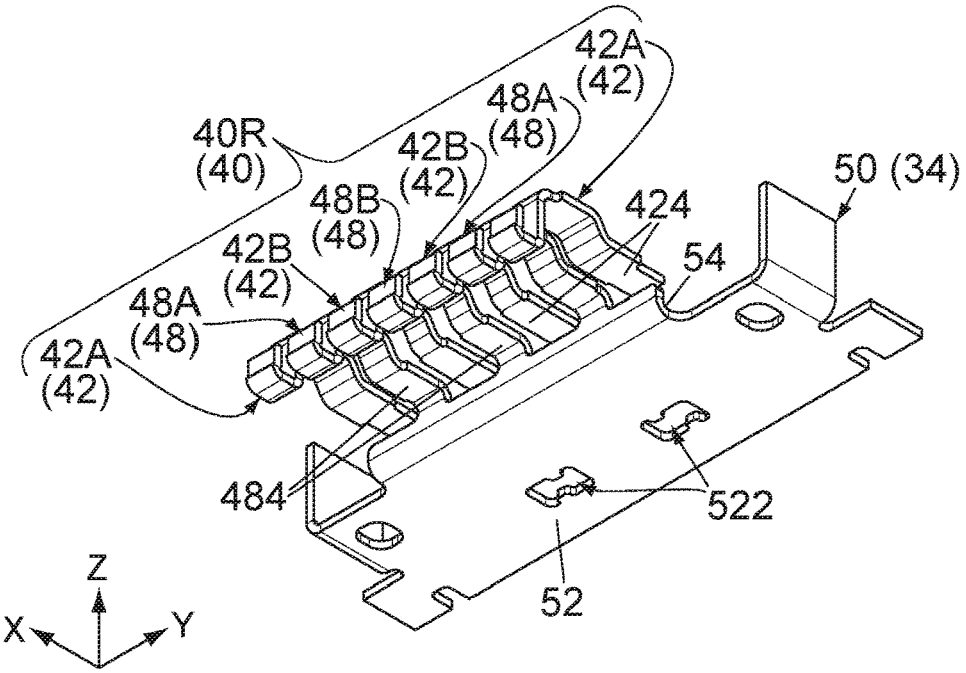
FIG. 15 is another perspective view showing the base shell and the terminals of FIG. 14.

Referring to FIGS. 14 and 15, the base shell 50 of the present embodiment is a part of a single metal plate with bends. The base shell 50 has a flat-plate portion 52 and a coupling portion 54. The flat-plate portion 52 extends in parallel to the horizontal plane (XY-plane) perpendicular to the Z-direction. The coupling portion 54 is connected to a front end of the flat-plate portion 52 and extends upward and forward (i.e. in the positive X-direction) in an arc. The flat-plate portion 52 is formed with two joint holes 522. Each of the joint holes 522 is a hole which passes through the flat-plate portion 52 in the Z-direction.

Referring to FIGS. 10 and 11, the base shell 50 is embedded in the holding member 33 except for a joint portion which is a part of the flat-plate portion 52 formed with the joint holes 522. The joint portion of the flat-plate portion 52 is entirely exposed from the holding member 33 and is arranged so as to couple lower ends of the two accommodation walls 332 of the holding member 33 to each other.

Figure 7:
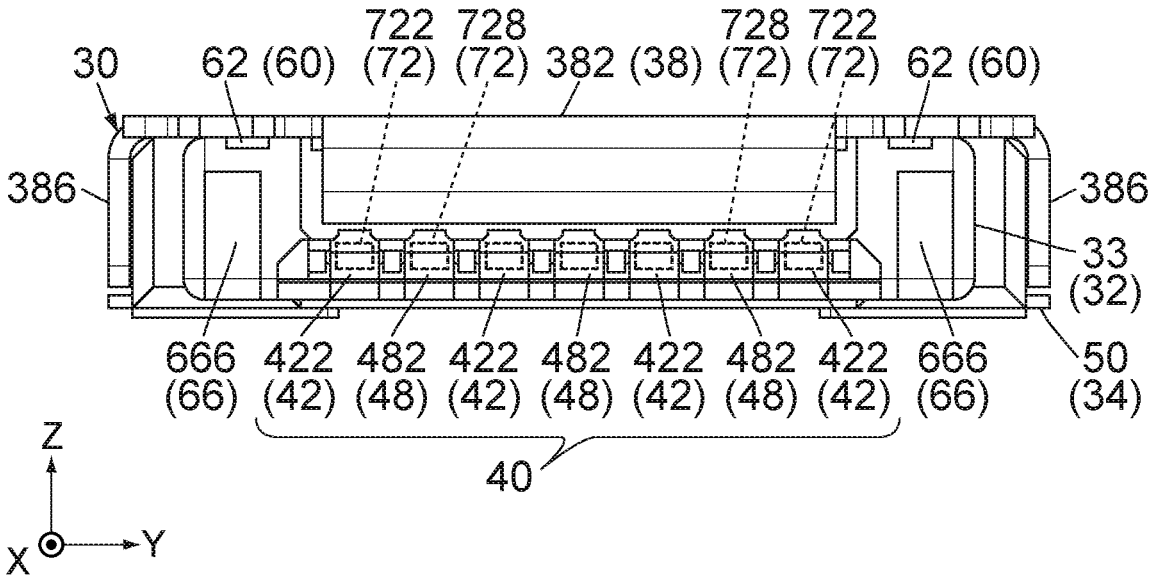
FIG. 7 is a front view showing the connector of FIG. 6, wherein positions of mating terminals of the mating connector under the mated state are partially illustrated with dashed line.

Referring to FIG. 11, the terminals 40 of the present embodiment are arranged in a single row in the Y-direction to form a terminal row 40R. Each of the terminals 40 is embedded in the holding member 33. Referring to FIG. 11 together with FIG. 1, the terminals 40 are provided so as to correspond to the mating terminals 72 of the mating connector 70, respectively. Each of the terminals 40 is exposed from the holding portion 336 which is the fit portion 30M. Referring to FIG. 7, each of the thus-arranged terminals 40 is brought into contact with the corresponding mating terminal 72 under the mated state to be electrically connected with the corresponding mating terminal 72.

Referring to FIGS. 14 and 15, the terminals 40 include a plurality of signal terminals 42 and a plurality of ground terminals 48. Each of the signal terminals 42 is a member separated from the base shell 50. More specifically, each of the signal terminals 42 is a single metal plate of constant thickness with bends. In contrast, each of the ground terminals 48 is a member integral with the base shell 50. More specifically, each of the ground terminals 48 is a single metal piece of constant thickness with bends and is coupled to the base shell 50. In detail, each of the ground terminals 48 has a coupling portion 484. Each of the coupling portions 484 is connected to a front end of the coupling portion 54 of the base shell 50 and extends forward therefrom. However, the present invention is not limited thereto. For example, each of the ground terminals 48 may be a member separable from the base shell 50 and may be in contact with the base shell 50.

Referring to FIG. 11, the signal terminals 42 and the ground terminals 48 are held by the holding member 33. The signal terminals 42 and the ground terminals 48 of the present embodiment are insert-molded in the holding member 33 and are embedded in the holding member 33. However, the present invention is not limited thereto. For example, the signal terminals 42 and the ground terminals 48 may be press-fit in the holding member 33 to be held by the holding member 33.

Referring to FIGS. 10 and 11, the ground members 60 are attached to the holding member 33. The ground members 60 of the present embodiment are insert-molded in the holding member 33. However, the present invention is not limited thereto. For example, the ground members 60 may be fit in the holding member 33.

The ground members 60 of the present embodiment are embedded in opposite sides of the holding portion 336 of the holding member 33 in the Y-direction, respectively. Each of the ground members 60 has a connecting portion 62, a coupling portion 64 and a ground portion 66. Each of the connecting portions 62 is exposed from an upper surface (positive Z-side surface) of the holding portion 336. Each of the coupling portions 64 couples the connecting portion 62 and the ground portion 66 to each other. Each of the ground portions 66 is exposed from side surfaces and a lower surface (negative Z-side surface) of the holding portion 336.

Referring to FIGS. 10 and 11 together with FIG. 1, the ground members 60 are provided so as to correspond to the holddowns 76 of the mating connector 70 (see FIG. 1), respectively. Referring to FIG. 5, each of the ground portions 66 is connected to the corresponding holddown 76 under the mated state. In detail, each of the ground portions 66 is brought into contact with the corresponding holddown 76 to be electrically connected to the corresponding holddown 76 under the mated state.

Each of the ground portions 66 of the present embodiment is pressed against the lock projection 762 of the corresponding holddown 76 under the mated state so that the mated state is frictionally locked. Thus, the ground portions 66 of the ground members 60 lock the mated state together with the holddowns 76 of the mating connector 70. However, the present invention is not limited thereto. For example, the ground portions 66 may be engaged with the holddowns 76, respectively, to lock the mated state. Moreover, the mated state may be locked by a part other than the ground portions 66. In this instance, each of the ground portions 66 may be merely in contact with the holddown 76.

Each of the terminals 40 and the ground members 60 of the present embodiment roughly has the aforementioned structure. The structure of each of the terminals 40 and the ground portions 66 of the ground members 60 will be described later in detail.

Referring to FIG. 8, the cable-holding structure 36 of the present embodiment holds a plurality of the cables 22 together. The cable-holding structure 36 comprises two ground bars 362 each made of conductor and a conductive member 364. Each of the ground bars 362 has a rectangular flat-plate shape. The two ground bars 362 vertically sandwich the outer conductors 226 which are exposed from the outer insulators 228. The conductive member 364 of the present embodiment is solder which fills space between the two ground bars 362. According to the aforementioned structure, each of the ground bars 362 is connected to the outer conductors 226 of the cables 22 to have ground potential same as that of the outer conductors 226.

Referring to FIGS. 8 and 9, the cable-holding structure 36 which holds the cables 22 is accommodated in a space formed between the two accommodation walls 332 of the holding member 33. The opposite ends of the cable-holding structure 36 in the Y-direction are received in the recessed portions 333 of the accommodation walls 332, respectively.

Referring to FIG. 11 together with FIG. 8, the cable-holding structure 36 which is accommodated as described above is fixed to the flat-plate portion 52 of the base shell 50. According to the present embodiment, the joint holes 522 of the base shell 50 are filled with solder (not shown) so that the base shell 50 is fixed and connected to the lower (negative Z-side) ground bar 362 of the cable-holding structure 36. Thus, the base shell 50 is electrically connected with the outer conductors 226 of the cables 22 to have ground potential same as that of the outer conductors 226. The base shell 50 of the present embodiment is indirectly connected to the outer conductors 226 via the cable-holding structure 36. However, the present invention is not limited thereto. For example, the base shell 50 may be directly connected to the outer conductors 226.

Referring to FIGS. 2, 3, 6 and 7, the cover shell 38 of the present embodiment is a single metal plate with bends and has a flat-plate portion 382 and two side plate portions 386. The flat-plate portion 382 extends in parallel to the XY-plane. The side plate portions 386 are connected to opposite sides of the flat-plate portion 382 in the Y-direction, respectively. Each of the side plate portions 386 extends in parallel to the XZ-plane.

Referring to FIG. 2, the flat-plate portion 382 is formed with two front joint holes 383 and two rear joint holes 384. Each of the front joint holes 383 and the rear joint holes 384 is a hole which passes through the flat-plate portion 382 in the Z-direction. The front joint holes 383 are located at a front part of the flat-plate portion 382. The rear joint holes 384 are located at a rear part of the flat-plate portion 382. Referring to FIGS. 2, 3 and 6, each of the side plate portions 386 is formed with an engagement hole 388. Each of the engagement holes 388 is a hole which passes through the side plate portion 386 in the Y-direction.

The cover shell 38 is attached to the base structure 32 from above. The engagement projections 334 of the base structure 32 are engaged with the engagement holes 388 of the cover shell 38, respectively, and the flat-plate portion 382 of the cover shell 38 almost entirely covers the base structure 32 from above.

Referring to FIG. 9, the cover shell 38 which is attached as described above is fixed to the cable-holding structure 36. According to the present embodiment, the rear joint holes 384 of the cover shell 38 are filled with solder (not shown) so that the cover shell 38 is fixed and connected to the upper (positive Z-side) ground bar 362 of the cable-holding structure 36. Thus, the cover shell 38 is electrically connected with the outer conductors 226 (see FIG. 8) of the cables 22 to have ground potential same as that of the outer conductors 226. The cover shell 38 of the present embodiment is indirectly connected to the outer conductors 226 via the cable-holding structure 36. However, the present invention is not limited thereto. For example, the cover shell 38 may be directly connected to the outer conductors 226.

Referring to FIG. 6, an upper part of the holding member 33 and opposite sides of the holding member 33 in the Y-direction are, at least in part, covered by the cover shell 38. In addition, a lower part of the holding member 33 is, at least in part, covered by the base shell 50. In other words, the holding member 33 of the present embodiment is, at least in part, covered by the cover shell 38 and the base shell 50, i.e. the two shells which are formed separately from each other, in the YZ-plane. However, the present invention is not limited thereto. For example, the cover shell 38 and the base shell 50 may be an integral member. Moreover, the structure of each of the cover shell 38 and the base shell 50 is not limited to the present embodiment.

Referring to FIG. 9, the flat-plate portion 382 of the cover shell 38 is fixed to the two ground members 60 in addition to the cable-holding structure 36. According to the present embodiment, each of the front joint holes 383 of the cover shell 38 are filled with solder (not shown) so that the cover shell 38 is fixed and connected to the connecting portions 62 of the two ground members 60. As a result, each of the ground members 60 is electrically connected with the outer conductors 226 (see FIG. 8) of the cables 22 to have ground potential same as that of the outer conductors 226. Thus, the connector 30 comprises the ground members 60 which are configured to be connected to the outer conductors 226 of the cables 22.

Each of the ground members 60 of the present embodiment is indirectly connected to the outer conductors 226 (see FIG. 8) via the cover shell 38 which is formed separately from the ground members 60. However, the present invention is not limited thereto. For example, each of the ground members 60 may be a member integral with the cover shell 38. Each of the ground members 60 may be indirectly connected to the outer conductors 226 via the base shell 50 or may be directly connected to the outer conductors 226.

Hereafter, further specific explanation will be made about the structure of each of the terminals 40 and the ground portions 66 of the ground members 60.

Referring to FIG. 18, the signal terminals 42 are provided so as to correspond to the cables 22, respectively. The ground terminals 48 are connected to the outer conductors 226 of the cables 22 via the base shell 50. Thus, the terminals 40 include a plurality of the signal terminals 42 which correspond to the cables 22, respectively, and a plurality of the ground terminals 48 which are configured to be connected with the outer conductors 226 of the cables 22.

For the connector 30 of the present embodiment, only the terminals 40 are configured to be connected to the mating terminals 72 (see FIG. 1) of the mating connector 70 (see FIG. 1). The terminals 40 consist of the signal terminals 42 and the ground terminals 48. However, the present invention is not limited thereto. For example, the terminals 40 of the connector 30 may be terminals which transmit low-speed signals together with the mating terminals 72. The mating connector 70 may comprise additional mating terminals (not shown) for transmitting high-speed signals in addition to the mating terminals 72. In this instance, the connector 30 may comprise additional terminals configured to be connected to the additional mating terminals in addition to the terminals 40.

Referring to FIG. 14, the signal terminals 42 have basic structures same as each other. More specifically, each of the signal terminals 42 has a first contact portion 422, a connection portion 424 and a first adjustment portion 426. Each of the first contact portions 422 extends rearward from a front end of the signal terminal 42 in the X-direction and has a J-like shape in the XZ-plane. Each of the connection portions 424 linearly extends forward from a rear end (negative X-side end) of the signal terminal 42. Each of the first adjustment portions 426 extends from the first contact portion 422 to the connection portion 424 in the X-direction. In detail, each of the first adjustment portions 426 linearly extends rearward from a rear end of the first contact portion 422 and then slopes downward to a front end of the connection portion 424.

Each of the signal terminals 42 of the present embodiment has the aforementioned basic structure. However, the present invention is not limited thereto. For example, each of the signal terminals 42 may further have another part in addition to the aforementioned portions.

Referring to FIG. 11, each of the first contact portions 422 is exposed from a front surface (positive X-side surface), a rear surface (negative X-side surface) and a lower surface of the holding portion 336. Referring to FIG. 7, the first contact portions 422 correspond to the mating signal terminals 722, respectively. The first contact portions 422 are brought into contact with the mating signal terminals 722 under the mated state, respectively. Referring to FIG. 9, the core wires 222 exposed from the inner insulators 224 are fixed on and connected to the connection portions 424, respectively, via soldering, etc. Thus, each of the signal terminals 42 has the connection portion 424 which is configured to be connected to the core wire 222 of the corresponding cable 22. Referring to FIG. 7 together with FIG. 1, the mating signal terminals 722 are electrically connected with the core wires 222 of the cables 22 via the signal terminals 42 under the mated state, respectively.

Referring to FIG. 14, the ground terminals 48 have basic structures same as each other. More specifically, each of the ground terminals 48 has a second contact portion 482 and a second adjustment portion 486 in addition to the previously described coupling portion 484. Each of the second contact portions 482 extends rearward from a front end of the ground terminal 48 in the X-direction and has a J-like shape in the XZ-plane. Each of the second adjustment portions 486 extends from the second contact portion 482 to the coupling portion 484 in the X-direction. In detail, each of second adjustment portion 486 linearly extends from a rear end of the second contact portion 482 and then slopes downward to a front end of the coupling portion 484.

Each of the ground terminals 48 of the present embodiment has the aforementioned basic structure. However, the present invention is not limited thereto. For example, as previously described, each of the ground terminals 48 may be a member formed separately from the base shell 50. In this instance, each of the ground terminals 48 may be connected to the base shell 50 via a member formed separately from the ground terminal 48. According to this modification, each of second adjustment portion 486 does not need to be provided with the coupling portion 484 but may extend from the second contact portion 482 to the rear end of the ground terminal 48 in the X-direction. Instead, each of the ground terminals 48 may further have another part in addition to the aforementioned portions.

Referring to FIG. 11, each of the second contact portions 482 is exposed from the front surface, the rear surface and the lower surface of the holding portion 336. Referring to FIG. 7, the second contact portions 482 correspond to the mating ground terminals 728, respectively. The second contact portions 482 are brought into contact with the mating ground terminals 728 under the mated state, respectively. Referring to FIG. 7 together with FIG. 1, the mating ground terminals 728 are electrically connected with the outer conductors 226 of the cables 22 via the ground terminals 48 under the mated state.

Referring to FIG. 14, the first contact portion 422 and the connection portion 424 of each of the signal terminals 42 are apart from each other in the X-direction. According to this structure, each of the signal terminals 42 can be reduced in size in the Z-direction while a size of the signal terminal 42 in the X-direction is made large. Thus, this structure enables the connector 30 (see FIG. 6) to be reduced in size in the Z-direction.

Referring to FIGS. 14 and 15, the signal terminals 42 and the ground terminals 48 are alternately arranged in the Y-direction to form one terminal row 40R. Referring to FIG. 15, the signal terminals 42 of the present embodiment include two outer signal terminals 42A and two inner signal terminals 42B. Each of the outer signal terminals 42A is located at an end of the terminal row 40R in the Y-direction. Each of the inner signal terminals 42B is located between adjacent two of the ground terminals 48 in the terminal row 40R in the Y-direction. In other words, each of the inner signal terminals 42B is located at an inner position of the terminal row 40R in the Y-direction. The ground terminals 48 of the present embodiment include two outer ground terminals 48A and one inner ground terminal 48B. Each of the outer ground terminals 48A is located between one of the outer signal terminals 42A and one of the inner signal terminals 42B in the Y-direction. The inner ground terminal 48B is located between the two inner signal terminals 42B in the Y-direction.

A typical arrangement of a terminal row of an existing cable connector is different from the aforementioned arrangement of the present embodiment. Specifically, every signal terminal is arranged between two of ground terminals. Thus, not two of the signal terminals but two of the ground terminals are arranged at opposite ends of the terminal row, respectively. Referring to FIG. 11 together with FIG. 6, according to the present embodiment, the ground terminals 48 are removed from the opposite ends of the terminal row 40R arranged in the Y-direction. Therefore, the connector 30 has a size in the Y-direction smaller than that of the existing connector which has the ground terminals 48 arranged at the opposite ends of the terminal row 40R. Thus, the present embodiment enables the connector 30 to be reduced in size in the Y-direction.

Figure 12:
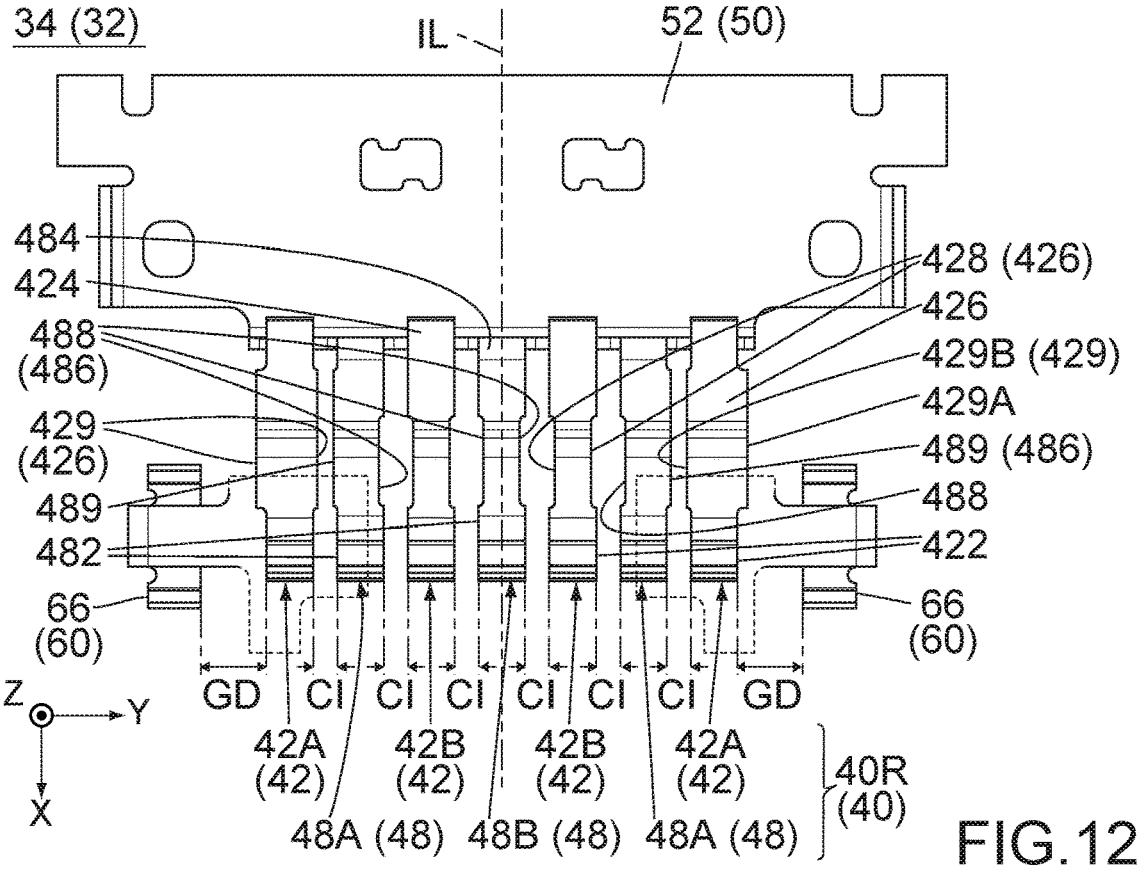
FIG. 12 is a plan view showing a conductor structure of the base structure of FIG. 10, wherein an outline of a connection portion of the ground member is illustrated with dashed line.

Referring to FIG. 12, the first contact portions 422 of all the signal terminals 42 and the second contact portions 482 of all the ground terminals 48 are arranged at regular intervals CI in the Y-direction. In other words, the first contact portions 422 and the second contact portions 482 of all the terminals 40 are arranged at equal pitches. This arrangement enables the connector 30 to be further reduced in size in the Y-direction by minimizing the regular interval CI in accordance with the structure of the connector 30 (see FIG. 6).

Referring to FIG. 15, the number of the outer signal terminals 42A of the present embodiment is two. The two outer signal terminals 42A are located at the opposite ends of the terminal row 40R in the Y-direction, respectively. The terminals 40 of the present embodiment consist of N of the signal terminals 42 and (N-1) of the ground terminals 48, N being an odd number of three or more. However, the present invention is not limited thereto. For example, the number of the outer signal terminals 42A may be one. In this instance, one of the outer signal terminals 42A and one of the outer ground terminals 48A may be located at the opposite ends of the terminal row 40R in the Y-direction, respectively. However, the arrangement of the present embodiment is preferable in order to reduce the size of the connector 30 (see FIG. 6) in the Y-direction as possible.

If one of the ground terminals, which is located at an end of the typical terminal row of the existing cable connector, is removed therefrom similarly to the present embodiment, one of the signal terminals is located at the end of the terminal row instead of the removed ground terminal. The outer signal terminal, i.e. the signal terminal located at the end of the terminal row, tends to have impedance higher than that of the inner signal terminal located at an inner position of the terminal row, i.e. the signal terminal located between two of the ground terminals. When the impedance of the outer signal terminal is higher than that of the inner signal terminal, the transmission characteristics of the connector might be degraded as a whole. As can be seen from this fact, the terminal row 40R of the present embodiment cannot be easily conceived from the typical terminal row of the existing cable connector.

Referring to FIG. 12, the connector 30 (see FIG. 6) of the present embodiment has an impedance adjustment mechanism which makes the impedance of the outer signal terminal 42A and the impedance of the inner signal terminal 42B be close to each other. This impedance adjustment mechanism includes the ground portions 66 of the ground members 60 in addition to the signal terminals 42 and the ground terminals 48. Hereafter, explanation will be made about the impedance adjustment mechanism of the present embodiment.

Figure 13:
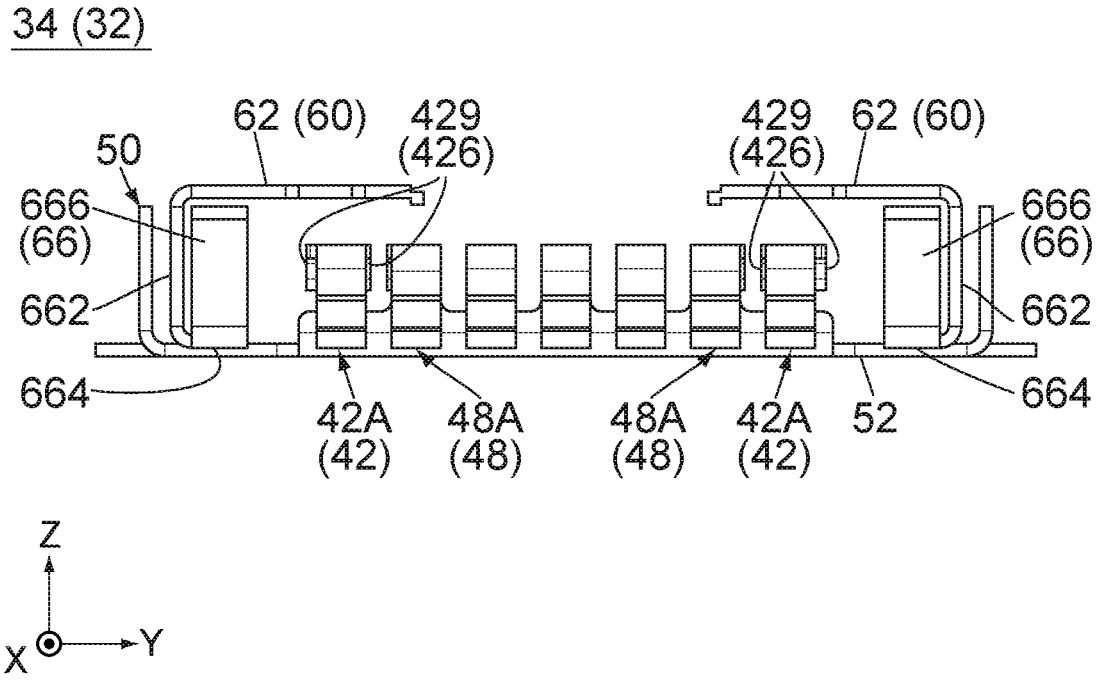
FIG. 13 is a front view showing the conductor structure of FIG. 12.

Referring to FIGS. 13, 18 and 19, the ground portion 66 of each of the ground members 60 of the present embodiment has a side plate 662, a lower plate 664, a front plate 666 and a rear plate 668.

Referring to FIG. 10, each of the side plates 662 extends downward from an outer end of the coupling portion 64 in the Y-direction and extends in parallel to the XZ-plane. Referring to FIG. 11, each of the side plates 662 is embedded in a side surface of an outer portion, which is an outer part of the holding portion 336 in the Y-direction, and is exposed outward in the Y-direction. Each of the lower plates 664 is connected to a lower end of the side plate 662 and extends in parallel to the XY-plane. Each of the lower plates 664 is embedded in a lower surface of the outer portion of the holding portion 336 and is exposed downward. Each of the front plates 666 extends upward from a front end of the lower plate 664 in parallel to the YZ-plane. Each of the front plates 666 is embedded in a front surface of the outer portion of the holding portion 336 and is exposed forward. Each of the rear plates 668 extends upward from a rear end of the lower plate 664 in parallel to the YZ-plane. Each of the rear plates 668 is embedded in a rear surface of the outer portion of the holding portion 336 and is exposed rearward.

Each of the ground portions 66 of the present embodiment has the aforementioned structure. However, the structure of each of the ground portions 66 is not specifically limited, provide that the ground portions 66 contribute to the impedance adjustment of the signal terminals 42 as described later.

Referring to FIGS. 19 and 20, each of the outer signal terminals 42A is located between the ground portion 66 of the ground member 60 and the outer ground terminal 48A, which is one of the ground terminals 48, in the Y-direction. Thus, one of the ground portions 66, each of which is a part of the ground member 60, is arranged outward of each of the outer signal terminals 42A in the Y-direction. As previously described, the ground members 60 are connected with the outer conductors 226 of the cables 22, and thereby each of the ground portions 66 has ground potential.

Figure 21:
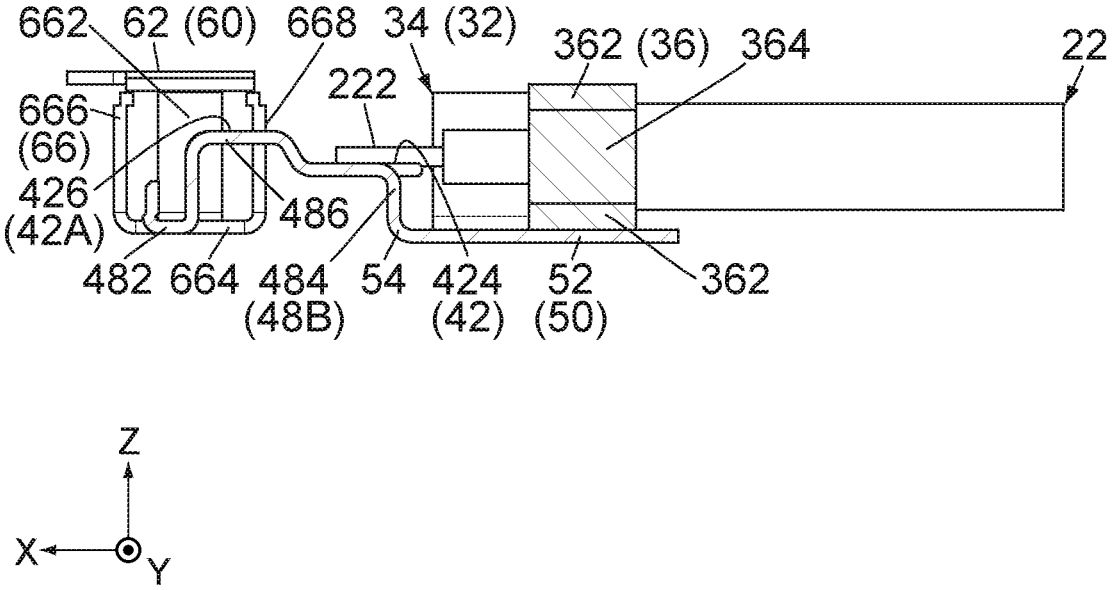
FIG. 21 is a cross-sectional view showing the connector of FIG. 19, taken along line XXI-XXI.
Figure 22:
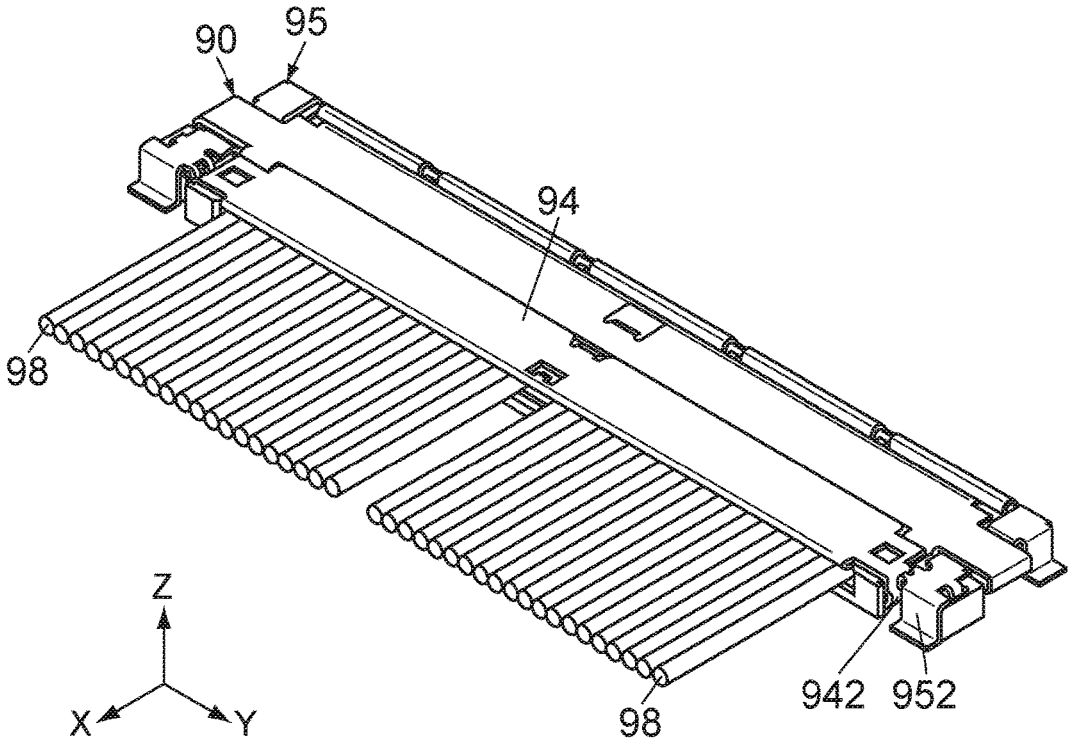
FIG.22 PRIOR ART
FIG. 22 is a perspective view showing a cable connector and an on-board connector of Patent Document 1.
Figure 23:
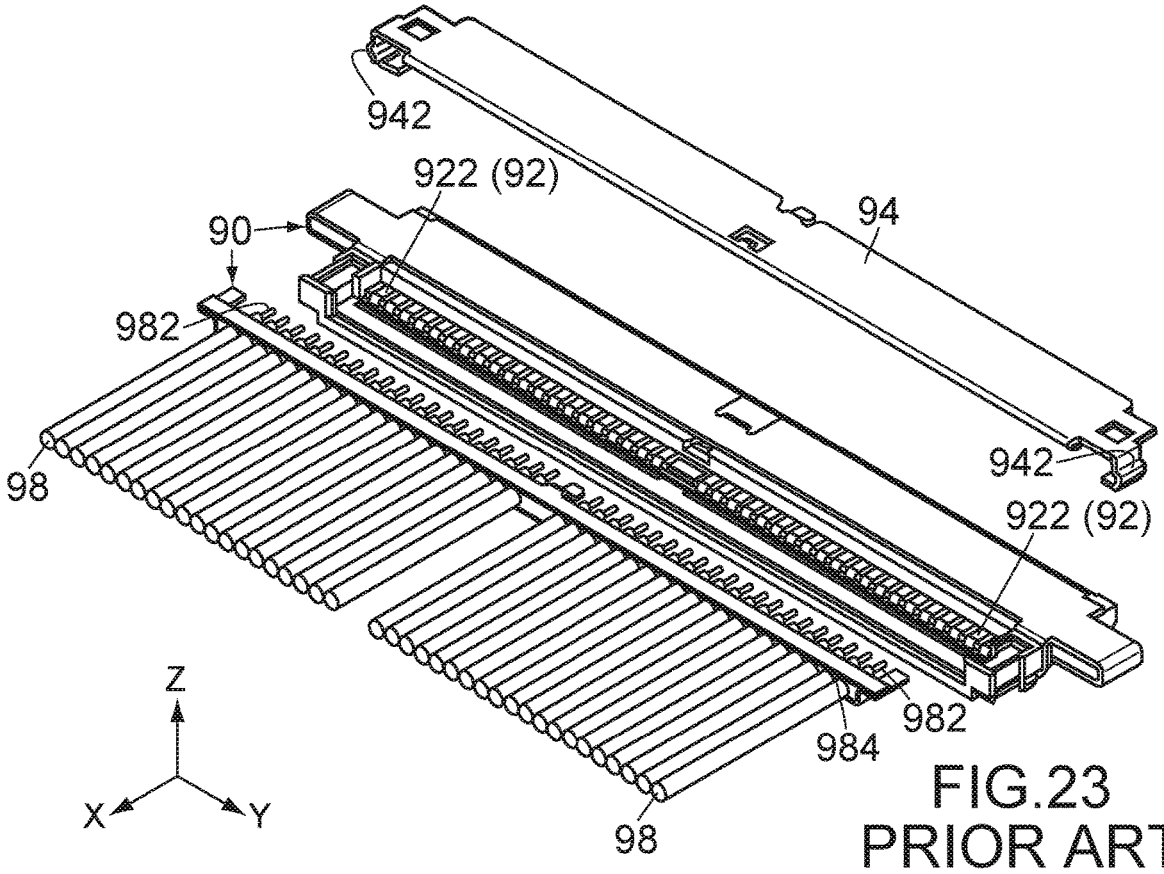
FIG.23 PRIOR ART
FIG. 23 is an exploded, perspective view showing the cable connector of FIG. 22.

Referring to FIG. 12, each of the ground portions 66 is apart from the first contact portion 422 of the outer signal terminal 42A in the Y-direction by a distance DG longer than the regular interval CI. Meanwhile, the first adjustment portion 426 of each of the outer signal terminals 42A protrudes toward the ground portion 66 in the Y-direction. Referring to FIGS. 17 and 21, the position of the first adjustment portion 426 of each of the outer signal terminals 42A in the XZ-plane is equal to or overlaps with the position of the ground portion 66 in the XZ-plane. These structures enable the impedance of each of the outer signal terminals 42A to be lowered even when the distance DG is longer than the regular interval CI.

Referring to FIG. 12, according to the present embodiment, the impedance of each of the outer signal terminals 42A can be lowered to be close to the impedance of the inner signal terminal 42B which is the signal terminal 42 located between two of the ground terminals 48, so that degradation of transmission characteristics of the connector 30 (see FIG. 1) can be prevented as a whole. Thus, the present embodiment provides the connector 30 which can be reduced in size in the Y-direction as well as size in the Z-direction, while degradation of transmission characteristics is prevented.

According to the present embodiment, the first adjustment portion 426 of each of the outer signal terminals 42A entirely protrudes toward the ground portion 66 in the Y-direction. In detail, each of the outer signal terminals 42A of the present embodiment has two first protrusions 429 consisting of a first outer protrusion 429A and a first inner protrusion 429B. The two first protrusions 429 are formed on opposite sides of the outer signal terminal 42A in the Y-direction, respectively, and protrude beyond the first contact portion 422 in orientations opposite to each other in the Y-direction. Each of the first protrusions 429 extends rearward from the rear end of the first contact portion 422 over the whole first adjustment portion 426. In particular, the first outer protrusion 429A protrudes beyond the first contact portion 422 toward the ground portion 66 in the Y-direction.

Each of the outer signal terminals 42A of the present embodiment has the aforementioned protrusions. However, the present invention is not limited thereto. For example, each of the first outer protrusions 429A may be partially provided on the first adjustment portion 426 of the outer signal terminal 42A. Thus, the first adjustment portion 426 of each of the outer signal terminals 42A may at least partially protrude toward the ground portion 66 in the Y-direction.

Referring to FIGS. 17 and 21, according to the present embodiment, the position of the first adjustment portion 426 of each of the outer signal terminals 42A in the XZ-plane overlaps with the position of the ground portion 66 in the XZ-plane. In detail, when the outer signal terminal 42A and the ground portion 66 are seen along the Y-direction, the first adjustment portion 426 overlaps with the rear plate 668 and the side plate 662 of the ground portion 66. However, the present invention is not limited thereto. For example, when the outer signal terminal 42A and the ground portion 66 are seen along the Y-direction, the first adjustment portion 426 may be entirely located in the ground portion 66. Thus, the position of the first adjustment portion 426 of each of the outer signal terminals 42A in the XZ-plane may be equal to or overlap with the position of the ground portion 66 in the XZ-plane. Moreover, each of the ground portions 66 may have an additional plate in addition to the side plate 662 or instead of the side plate 662. The additional plate may be located at an inner side of the ground portion 66 in the Y-direction.

Figure 16:
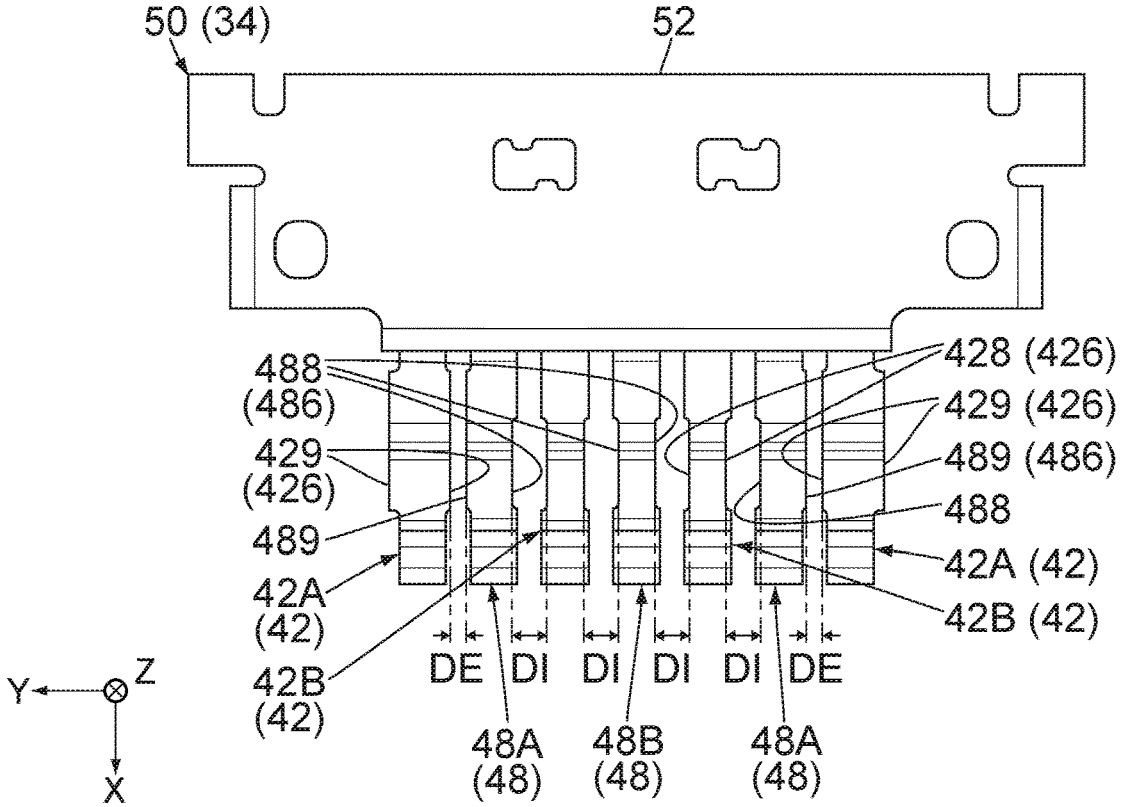
FIG. 16 is a bottom view showing the base shell and the terminals of FIG. 14.

Referring to FIG. 16, the first adjustment portion 426 of each of the inner signal terminals 42B of the present embodiment is apart from the second adjustment portion 486 of each of adjacent two of the ground terminals 48 by an inner predetermined distance DI in the Y-direction. The first adjustment portion 426 of each of the outer signal terminals 42A is apart from the second adjustment portion 486 of the outer ground terminal 48A, i.e. adjacent one of the ground terminals 48, by an outer predetermined distance DE in the Y-direction. The inner predetermined distance DI is longer than the outer predetermined distance DE.

According to the present embodiment, because the first adjustment portion 426 of each of the inner signal terminals 42B is located to be far away from each of the ground terminals 48, the impedance of the inner signal terminal 42B can be made high. Thus, the impedance of each of the inner signal terminals 42B is made higher to be close to the impedance of each of the outer signal terminals 42A. As a result, degradation of transmission characteristics of the connector 30 (see FIG. 1) can be prevented as a whole. However, the present invention is not limited thereto. For example, when the impedance of each of the outer signal terminals 42A can be sufficiently lowered, the impedance of each of the inner signal terminals 42B does not need to be made high.

The first adjustment portion 426 of each of the inner signal terminals 42B of the present embodiment is recessed inward in the Y-direction so as to be away from the second adjustment portion 486 of each of the adjacent two of the ground terminals 48 in the Y-direction. In addition, the second adjustment portion 486 of each of the adjacent two of the ground terminals 48 is recessed inward in the Y-direction so as to be away from the first adjustment portion 426 of the inner signal terminal 42B in the Y-direction. More specifically, the second adjustment portion 486 of each of the outer ground terminals 48A is recessed inward in the Y-direction so as to be away from the first adjustment portion 426 of adjacent one of the inner signal terminals 42B in the Y-direction. The second adjustment portion 486 of the inner ground terminal 48B is recessed inward in the Y-direction so as to be away from the first adjustment portion 426 of each of adjacent two of the inner signal terminals 42B in the Y-direction.

In detail, each of the inner signal terminals 42B of the present embodiment has two first recesses 428. The two first recesses 428 are formed on opposite sides of the inner signal terminal 42B in the Y-direction, respectively, and are recessed from the first contact portion 422 in orientations opposite to each other in the Y-direction. Each of the first recesses 428 extends rearward from the rear end of the first contact portion 422 over the whole first adjustment portion 426.

Each of the ground terminals 48 has one or two second recesses 488. For each of the outer ground terminals 48A, only one of the second recesses 488 is formed on an inner side of the outer ground terminal 48A in the Y-direction and is recessed outward of the terminal row 40R (see FIG. 15) in the Y-direction from the second contact portion 482. For each of the inner ground terminals 48B, two of the second recesses 488 are formed on opposite sides of the inner ground terminal 48B in the Y-direction and are recessed from the second contact portion 482 in orientations opposite to each other in the Y-direction. Each of the second recesses 488 extends rearward from the rear end of the second contact portion 482 over the whole second adjustment portion 486.

Each of the inner signal terminals 42B and the ground terminals 48 of the present embodiment has the aforementioned recesses. These recesses of the present embodiment enable the inner predetermined distance DI to be longer than the outer predetermined distance DE. However, the present invention is not limited thereto. For example, only the first recesses 428 or only the second recesses 488 may be provided.

Referring to FIG. 12, the first adjustment portion 426 of each of the outer signal terminals 42A of the present embodiment protrudes toward the second adjustment portion 486 of the outer ground terminal 48A, i.e. the adjacent one of the ground terminals 48, in the Y-direction. In addition, the second adjustment portion 486 of each of the outer ground terminals 48A, each of which is the adjacent one of the ground terminals 48, protrudes toward the first adjustment portion 426 of the outer signal terminal 42A in the Y-direction.

In detail, the first inner protrusion 429B of each of the outer signal terminals 42A of the present embodiment protrudes beyond the first contact portion 422 toward the outer ground terminal 48A in the Y-direction. In addition, each of the outer ground terminals 48A has one second protrusion 489. For each of the outer ground terminals 48A, the second protrusion 489 is formed on an outer side of the outer ground terminal 48A in the Y-direction and protrudes outward in the Y-direction beyond the second contact portion 482. Each of the second protrusions 489 extends rearward from the rear end of the second contact portion 482 over the whole second adjustment portion 486.

Referring to FIG. 16, each of the outer signal terminals 42A and the outer ground terminals 48A of the present embodiment has the aforementioned protrusion. These protrusions of the present embodiment enable the inner predetermined distance DI to be longer than the outer predetermined distance DE. However, the present invention is not limited thereto. For example, only the first protrusions 429 or only the second protrusions 489 may be provided.

Referring to FIG. 12, according to the present embodiment, a size of the first outer protrusion 429A in the Y-direction, namely a protruding amount, is larger than a size of the first inner protrusion 429B in the Y-direction, namely another protruding amount. However, the present invention is not limited thereto. The protruding amount of each of the first outer protrusions 429A and the first inner protrusions 429B may be designed in accordance with a positional relation to the other conductors such as the regular interval CI and the distance DG.

Referring to FIG. 12, each of the inner signal terminals 42B and the inner ground terminal 48B of the present embodiment has a symmetric shape with respect to the XZ-plane. Each of the outer signal terminals 42A and the outer ground terminals 48A has an asymmetric shape with respect to the XZ-plane. The terminal row 40R of the present embodiment has a symmetric structure with respect to an imaginary line IL which extends along the X-direction through a middle point of the terminal row 40R in the Y-direction. In other words, the terminal row 40R has a plane symmetric structure with respect to a plane which is in parallel to the XZ-plane and includes the imaginary line IL. In particular, when the terminal row 40R is seen along the Z-direction, the terminal row 40R has a line symmetric structure with respect to the imaginary line IL. According to this symmetric structure, the impedance of the signal terminals 42 can be easily adjusted. However, the present invention is not limited thereto. For example, the terminal row 40R may have an asymmetric structure with respect to the imaginary line IL.

Referring to FIGS. 14 and 17, the first contact portion 422 and the first adjustment portion 426 of each of the signal terminals 42 form a shape, namely a first shape, in the XZ-plane. The first shapes of the signal terminals 42 are same as each other. The second contact portion 482 and the second adjustment portion 486 of each of the ground terminals 48 form a shape, namely a second shape, in the XZ-plane. The second shapes of the ground terminals 48 are same as each other. The first shape and the second shape are identical to each other. According to this structure, the impedance of the signal terminals 42 can be adjusted while the size of the connector 30 (see FIG. 6) in the XZ-plane is not made large. However, the present invention is not limited thereto. For example, the first shape and the second shape may be different from each other.

Referring to FIG. 17, according to the present embodiment, the positions of the first adjustment portions 426 of all the signal terminals 42 in the XZ-plane are completely equal to the positions of the second adjustment portions 486 of all the ground terminals 48 in the XZ-plane. In addition, the positions of the first contact portions 422 of all the signal terminals 42 in the XZ-plane are completely equal to the positions of the second contact portions 482 of all the ground terminals 48 in the XZ-plane. According to this arrangement, the impedance of the signal terminals 42 can be easily adjusted by adjusting the sizes of the first adjustment portions 426 and the second adjustment portions 486 in the Y-direction. However, the present invention is not limited thereto. For example, a position of each of the first adjustment portions 426 in the XZ-plane may be equal to or overlaps with a position of each of the second adjustment portions 486 in the XZ-plane.

The present embodiment can be further variously modified in addition to the already described modifications. For example, referring to FIG. 12, the first contact portions 422, the second contact portions 482, the connection portions 424 and the coupling portions 484 of the present embodiment have sizes same as each other in the Y-direction and extend straight along the X-direction. However, the present invention is not limited thereto. For example, each of the first contact portions 422, the second contact portions 482, the connection portions 424 and the coupling portions 484 may be bent in the Y-direction.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to be connected to a plurality of cables and mateable with a mating connector from above in an upper-lower direction, the mating connector being mounted on a board, wherein:

each of the cables has a core wire and an outer conductor;

the mating connector comprises a plurality of mating signal terminals, a plurality of ground terminals and a holddown;

the connector comprises a plurality of terminals, a holding member and a ground member which is configured to be connected to the outer conductors of the cables;

the terminals include a plurality of signal terminals which correspond to the cables, respectively, and a plurality of ground terminals which are configured to be connected to the outer conductors of the cables;

the signal terminals and the ground terminals are held by the holding member and are alternately arranged in a pitch direction perpendicular to the upper-lower direction to form one terminal row;

the ground member is attached to the holding member and has a ground portion;

the ground portion is connected to the holddown under a mated state where the connector is mated with the mating connector;

each of the signal terminals has a first contact portion, a first adjustment portion and a connection portion which is configured to be connected to the core wire of a corresponding one of the cables;

the first contact portions are brought into contact with the mating signal terminals, respectively, under the mated state;

the first contact portion and the connection portion of each of the signal terminals are apart from each other in a front-rear direction perpendicular to both the upper-lower direction and the pitch direction;

each of the first adjustment portions extends from the first contact portion to the connection portion in the front-rear direction;

each of the ground terminals has a second contact portion and a second adjustment portion;

the second contact portions are brought into contact with the mating ground terminals, respectively, under the mated state;

each of the second adjustment portions extends from the second contact portion in the front-rear direction;

a position of each of the first adjustment portions in a perpendicular plane defined by the upper-lower direction and the front-rear direction is equal to or overlaps with a position of each of the second adjustment portions in the perpendicular plane;

the signal terminals include an outer signal terminal;

the outer signal terminal is located at an end of the terminal row and is located between the ground portion of the ground member and one of the ground terminals in the pitch direction;

the first adjustment portion of the outer signal terminal at least partially protrudes toward the ground portion in the pitch direction;

a position of the first adjustment portion of the outer signal terminal in the perpendicular plane is equal to or overlaps with a position of the ground portion in the perpendicular plane;

the first contact portions and the second contact portions are arranged at regular intervals in the pitch direction; and the ground portion is apart from the first contact portion of the outer signal terminal by a distance longer than the regular interval in the pitch direction.

2. The connector as recited in claim 1, wherein:

the signal terminals include an inner signal terminal;

the inner signal terminal is located between adjacent two of the ground terminals in the terminal row;

the first adjustment portion of the inner signal terminal is apart from the second adjustment portion of each of the adjacent two of the ground terminals by an inner predetermined distance in the pitch direction;

the first adjustment portion of the outer signal terminal is apart from the second adjustment portion of adjacent one of the ground terminals by an outer predetermined distance in the pitch direction; and the inner predetermined distance is longer than the outer predetermined distance.

3. The connector as recited in claim 2, wherein:

the first adjustment portion of the inner signal terminal is recessed inwards in the pitch direction so as to be away from the second adjustment portion of each of the adjacent two of the ground terminals in the pitch direction; and the second adjustment portion of each of the adjacent two of the ground terminals is recessed inwards in the pitch direction so as to be away from the first adjustment portion of the inner signal terminal in the pitch direction.

4. The connector as recited in claim 2, wherein:

the first adjustment portion of the outer signal terminal protrudes toward the second adjustment portion of the adjacent one of the ground terminals in the pitch direction; and the second adjustment portion of the adjacent one of the ground terminals protrudes toward the first adjustment portion of the outer signal terminal.

5. The connector as recited in claim 1, wherein:

the first contact portion and the first adjustment portion of each of the signal terminals form a first shape in the perpendicular plane;

the second contact portion and the second adjustment portion of each of the ground terminals form a second shape in the perpendicular direction; and the first shape and the second shape are identical to each other.

6. The connector as recited in claim 1, wherein the ground portion of the ground member locks the mated state together with the holddown of the mating connector.

7. The connector as recited in claim 1, wherein:

the terminals consist of N of the signal terminals and (N-1) of the ground terminals, N being an odd number of three or more; and the terminal row has a symmetric structure with respect to an imaginary line which extends along the front-rear direction through a middle point of the terminal row in the pitch direction.

8. The connector as recited in claim 1, wherein the signal terminals and the ground terminals are insert-molded in the holding member.

9. A harness comprising the connector and the plurality of the cables as recited in claim 1.

10. A connector assembly comprising the connector and the mating connector as recited in claim 1.

* * * * *